US009152079B2

(12) United States Patent
Tsuchiya et al.

(10) Patent No.: US 9,152,079 B2
(45) Date of Patent: Oct. 6, 2015

(54) IMAGE FORMING APPARATUS HAVING DEVELOPER AMOUNT DETERMINATION

(75) Inventors: Toshikazu Tsuchiya, Susono (JP); Masafumi Monde, Yokohama (JP); Hidetoshi Hanamoto, Mishima (JP); Tsutomu Ishida, Suntou (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 21 days.

(21) Appl. No.: 13/885,047

(22) PCT Filed: Nov. 18, 2011

(86) PCT No.: PCT/JP2011/077271
§ 371 (c)(1), (2), (4) Date: May 13, 2013

(87) PCT Pub. No.: WO2012/070664
PCT Pub. Date: May 31, 2012

(65) Prior Publication Data

US 2013/0223857 A1 Aug. 29, 2013

(30) Foreign Application Priority Data

Nov. 24, 2010 (JP) ..... 2010-261210
Mar. 2, 2011 (JP) ..... 2011-045110

(51) Int. Cl.
*G03G 15/08* (2006.01)

(52) U.S. Cl.
CPC ..... *G03G 15/0822* (2013.01); *G03G 15/0858* (2013.01); *G03G 2215/0888* (2013.01)

(58) Field of Classification Search
CPC ..... G03G 15/08; G03G 2215/0888; G03G 15/0856; G03G 15/0858; G03G 15/086
USPC ..... 399/27, 44, 119, 254
See application file for complete search history.

(56) References Cited

U.S. PATENT DOCUMENTS 4,506,804 A * 3/1985 Oka ..... 222/64
4,592,642 A * 6/1986 Imaizumi et al. ..... 399/27
(Continued)

FOREIGN PATENT DOCUMENTS

EP 1 265 111 A2 12/2002
EP 2 009 511 A1 12/2008
(Continued)

OTHER PUBLICATIONS

International Search Report and Written Opinion (ISR/WO) mailed Apr. 23, 2012, in PCT/JP2011/077271.
(Continued)

*Primary Examiner* — G. M. Hyder
(74) *Attorney, Agent, or Firm* — Fitzpatrick, Cella, Harper & Scinto

(57) ABSTRACT

A developing apparatus includes a developing unit configured to be detachable from and attachable to an image forming apparatus to contain a developer, a rotary member configured to rotate in the developing unit, and a detection unit installed on an internal surface of the developing unit and configured to detect a pressure caused by pressure through the developer by rotation of the rotary member. In addition, a measurement unit is configured to measure a period in which the pressure is changed, and a determination unit is configured to determine an amount of the developer in the developing unit based on the period detected by the measurement unit.

13 Claims, 26 Drawing Sheets

(56) References Cited

U.S. PATENT DOCUMENTS

| | | | | |
|---|---|---|---|---|
| 4,987,449 | A * | 1/1991 | Katoh | 399/28 |
| 5,755,358 | A * | 5/1998 | Fisk | 222/23 |
| 5,790,917 | A * | 8/1998 | Takura et al. | 399/27 |
| 8,150,276 | B2 | 4/2012 | Joo et al. | |
| 2005/0019046 | A1* | 1/2005 | Suenaga et al. | 399/27 |
| 2009/0214229 | A1 | 8/2009 | Joo et al. | |
| 2012/0148271 | A1* | 6/2012 | Fukita et al. | 399/27 |
| 2013/0039670 | A1* | 2/2013 | Hosoya et al. | 399/27 |
| 2013/0223857 | A1* | 8/2013 | Tsuchiya et al. | 399/27 |
| 2013/0266330 | A1* | 10/2013 | Monde et al. | 399/27 |

FOREIGN PATENT DOCUMENTS

| | | | |
|---|---|---|---|
| GB | 2 313 473 | A | 11/1997 |
| JP | 64-6986 | A | 1/1989 |
| JP | 03236076 | A | 10/1991 |
| JP | H05-046026 | A | 2/1993 |
| JP | 10-186823 | A | 7/1998 |
| JP | 2002-132036 | A | 5/2002 |
| JP | 2006106590 | A * | 4/2006 |
| JP | 2008-164676 | A | 7/2008 |
| JP | 2012181422 | A * | 9/2012 |
| JP | 2012181424 | A * | 9/2012 |

OTHER PUBLICATIONS

International Preliminary Report on Patentability mailed Jun. 6, 2013, in International Application No. PCT/JP2011/077271.

U.S. Appl. No. 13/991,952, filed Jun. 6, 2013.

Japanese Office Action issued in Japanese Application No. 2010-261210, dated Aug. 19, 2014.

English Translation of Japanese Office Action dated Jan. 20, 2015, in related Japanese Patent Application No. 2011-045110.

Japanese Office Action dated Jan. 20, 2015, in related Japanese Patent Application No. 2011-045110.

Japanese Office Action dated Apr. 14, 2015, in related Japanese Patent Application No. 2011-045110.

* cited by examiner

FIG. 4A
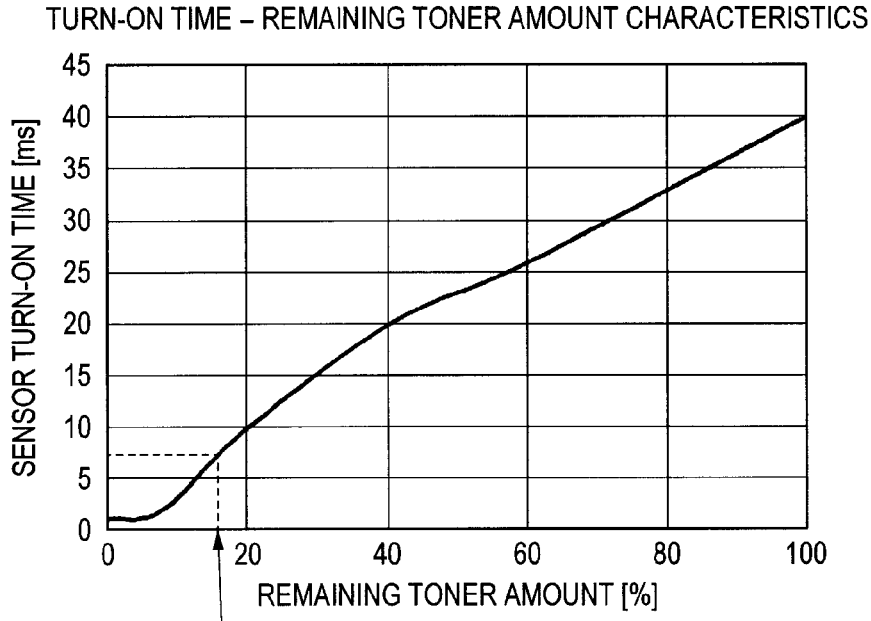
FIG. 4B
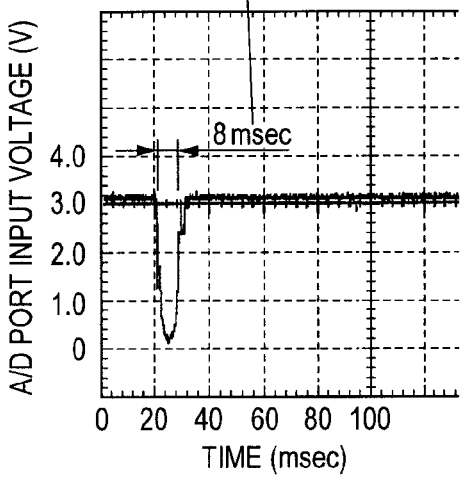
FIG. 4C
TABLE T
| SENSOR TURN-ON TIME (ms) | REMAINING TONER AMOUNT (%) |
|---|---|
| 0.0 | 0 |
| 1.5 | 5 |
| 3.0 | 10 |
| 7.4 | 15 |
| 9.8 | 20 |
| 12.1 | 25 |
| 14.4 | 30 |
| 16.6 | 35 |
| 18.8 | 40 |
| 20.9 | 45 |
| 22.9 | 50 |
| 24.9 | 55 |
| 26.8 | 60 |
| 28.7 | 65 |
| 30.5 | 70 |
| 32.2 | 75 |
| 33.9 | 80 |
| 35.5 | 85 |
| 37.1 | 90 |
| 38.6 | 95 |
| 40.0 | 100 |

TABLE N

| A/D PORT INPUT VOLTAGE (V) | TONER REMAINING AMOUNT (%) |
|---|---|
| 2.886 | 0 |
| 2.665 | 5 |
| 2.399 | 10 |
| 2.134 | 15 |
| 1.953 | 20 |
| 1.71 | 25 |
| 1.6 | 30 |
| 1.571 | 35 |
| 1.476 | 40 |
| 1.46 | 45 |
| 1.444 | 50 |
| 1.427 | 55 |
| 1.411 | 60 |
| 1.394 | 65 |
| 1.377 | 70 |
| 1.359 | 75 |
| 1.342 | 80 |
| 1.324 | 85 |
| 1.306 | 90 |
| 1.288 | 95 |
| 1.27 | 100 |

FIG. 8A
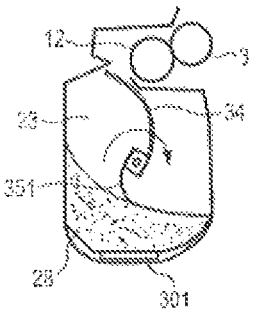
FIG. 8B
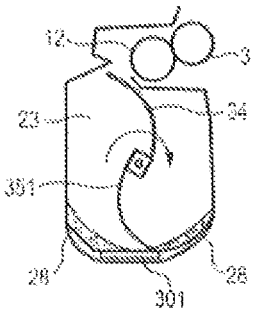
FIG. 8C
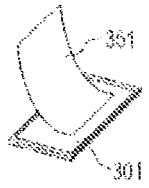
FIG. 8D
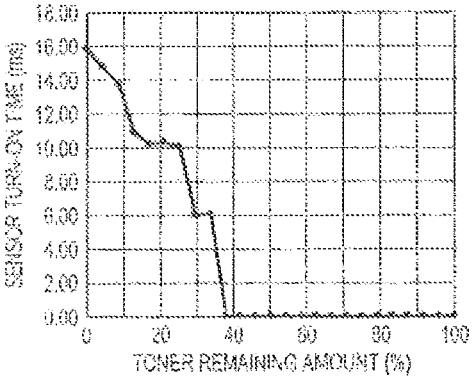
FIG. 8E
TABLE M
| SENSOR TURN-ON TIME (ms) | TONER REMAINING AMOUNT (%) |
|---|---|
| 0.00 | 100 |
| 0.00 | 96 |
| 0.00 | 92 |
| 0.00 | 87 |
| 0.00 | 83 |
| 0.00 | 79 |
| 0.00 | 75 |
| 0.00 | 71 |
| 0.00 | 67 |
| 0.00 | 62 |
| 0.00 | 58 |
| 0.00 | 54 |
| 0.00 | 50 |
| 0.00 | 46 |
| 0.00 | 42 |
| 0.00 | 38 |
| 5.06 | 33 |
| 6.00 | 29 |
| 10.02 | 25 |
| 10.36 | 21 |
| 10.20 | 17 |
| 10.95 | 13 |
| 13.92 | 8 |
| 14.78 | 4 |
| 15.86 | 0 |

TABLE T

| A/D PORT INPUT VOLTAGE (V) | TONER REMAINING AMOUNT (%) |
|---|---|
| 3.00 | 100 |
| 3.00 | 96 |
| 3.00 | 92 |
| 3.00 | 87 |
| 3.00 | 83 |
| 3.00 | 79 |
| 3.00 | 75 |
| 3.00 | 71 |
| 3.00 | 67 |
| 3.00 | 62 |
| 3.00 | 58 |
| 3.00 | 54 |
| 3.00 | 50 |
| 3.00 | 46 |
| 3.00 | 42 |
| 3.00 | 38 |
| 3.00 | 33 |
| 2.95 | 29 |
| 2.90 | 25 |
| 2.85 | 21 |
| 2.80 | 17 |
| 2.75 | 13 |
| 2.50 | 8 |
| 2.30 | 4 |
| 2.25 | 0 |

FIG. 11A
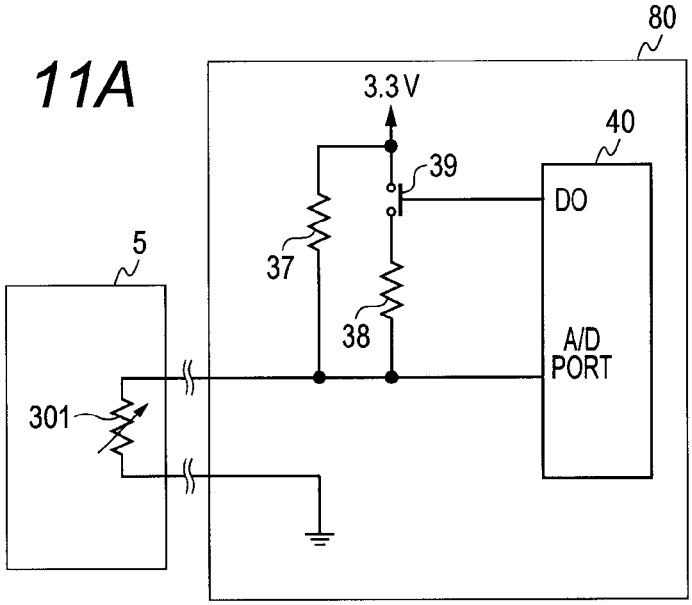
FIG. 11B
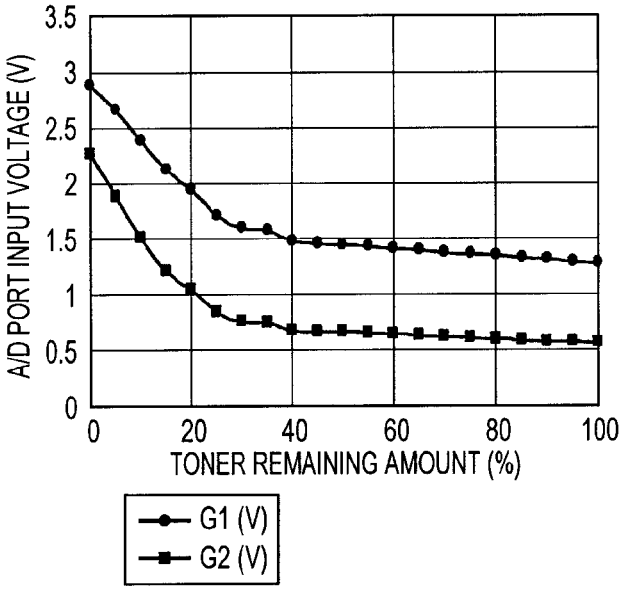
FIG. 11C
TABLE X
| G1 (V) | G2 (V) | TONER REMAINING AMOUNT [%] |
|---|---|---|
| 2.886 | 2.233 | 0 |
| 2.665 | 1.839 | 5 |
| 2.399 | 1.466 | 10 |
| 2.134 | 1.17 | 15 |
| 1.953 | 1.001 | 20 |
| 1.71 | 0.805 | 25 |
| 1.6 | 0.727 | 30 |
| 1.571 | 0.707 | 35 |
| 1.476 | 0.645 | 40 |
| 1.46 | 0.635 | 45 |
| 1.444 | 0.624 | 50 |
| 1.427 | 0.614 | 55 |
| 1.411 | 0.604 | 60 |
| 1.394 | 0.594 | 65 |
| 1.377 | 0.583 | 70 |
| 1.359 | 0.573 | 75 |
| 1.342 | 0.563 | 80 |
| 1.324 | 0.552 | 85 |
| 1.306 | 0.542 | 90 |
| 1.288 | 0.532 | 95 |
| 1.27 | 0.521 | 100 |
A
B

FIG. 13C TABLE Q

| A/D PORT INPUT VOLTAGE (V) | TEMPERATURE (°C) |
|---|---|
| 2.983 | 0 |
| 2.967 | 1 |
| 2.951 | 2 |
| 2.934 | 3 |
| 2.916 | 4 |
| 2.898 | 5 |
| 2.879 | 6 |
| 2.860 | 7 |
| 2.840 | 8 |
| 2.820 | 9 |
| 2.799 | 10 |
| 2.778 | 11 |
| 2.755 | 12 |
| 2.733 | 13 |
| 2.709 | 14 |
| 2.686 | 15 |
| 2.661 | 16 |
| 2.637 | 17 |
| 2.611 | 18 |
| 2.585 | 19 |
| 2.559 | 20 |
| 2.532 | 21 |
| 2.505 | 22 |
| 2.477 | 23 |
| 2.449 | 24 |
| 2.420 | 25 |
| 2.391 | 26 |
| 2.362 | 27 |
| 2.332 | 28 |
| 2.302 | 29 |
| 2.271 | 30 |
| 2.240 | 31 |
| 2.209 | 32 |
| 2.177 | 33 |
| 2.146 | 34 |
| 2.114 | 35 |
| 2.082 | 36 |
| 2.049 | 37 |
| 2.017 | 38 |
| 1.985 | 39 |
| 1.953 | 40 |
| 1.919 | 41 |
| 1.887 | 42 |
| 1.854 | 43 |
| 1.821 | 44 |
| 1.789 | 45 |
| 1.756 | 46 |
| 1.724 | 47 |
| 1.692 | 48 |
| 1.660 | 49 |
| 1.628 | 50 |

FIG. 18A
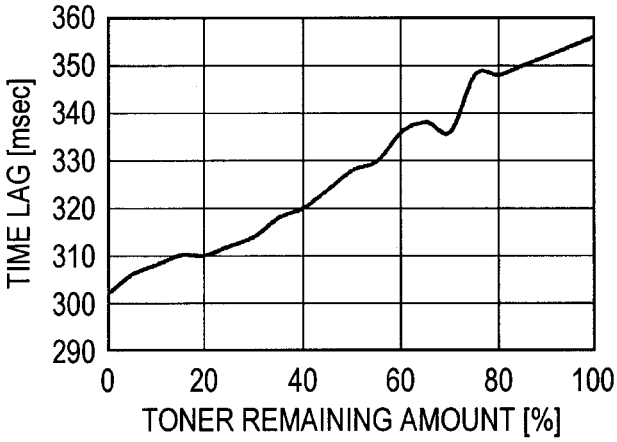
FIG. 18B
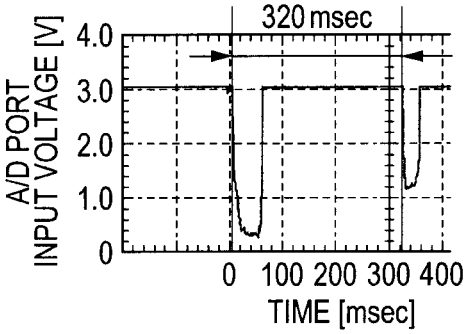
FIG. 18C
TABLE T
| TIME LAG [msec] | TONER REMAINING AMOUNT [%] |
|---|---|
| 350.0 | 100 |
| 347.5 | 95 |
| 345.0 | 90 |
| 342.5 | 85 |
| 340.0 | 80 |
| 337.5 | 75 |
| 335.0 | 70 |
| 332.5 | 65 |
| 330.0 | 60 |
| 327.5 | 55 |
| 325.0 | 50 |
| 322.5 | 45 |
| 320.0 | 40 |
| 317.5 | 35 |
| 315.0 | 30 |
| 312.5 | 25 |
| 310.0 | 20 |
| 307.5 | 15 |
| 305.0 | 10 |
| 302.5 | 5 |
| 300.0 | 0 |

FIG. 21A
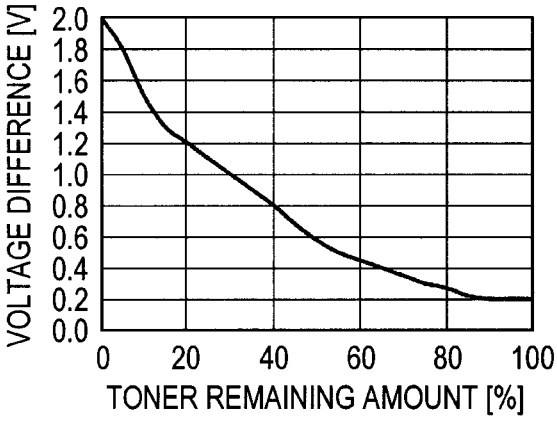
FIG. 21B
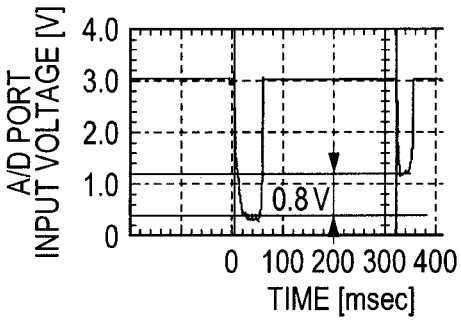
FIG. 21C
TABLE N
| VOLTAGE DIFFERENCE [V] | TONER REMAINING AMOUNT [%] |
|---|---|
| 0.18 | 100 |
| 0.20 | 95 |
| 0.23 | 90 |
| 0.25 | 85 |
| 0.27 | 80 |
| 0.30 | 75 |
| 0.35 | 70 |
| 0.40 | 65 |
| 0.45 | 60 |
| 0.50 | 55 |
| 0.57 | 50 |
| 0.65 | 45 |
| 0.80 | 40 |
| 0.85 | 35 |
| 0.95 | 30 |
| 1.10 | 25 |
| 1.20 | 20 |
| 1.45 | 15 |
| 1.55 | 10 |
| 1.80 | 5 |
| 2.00 | 0 |

FIG. 23A
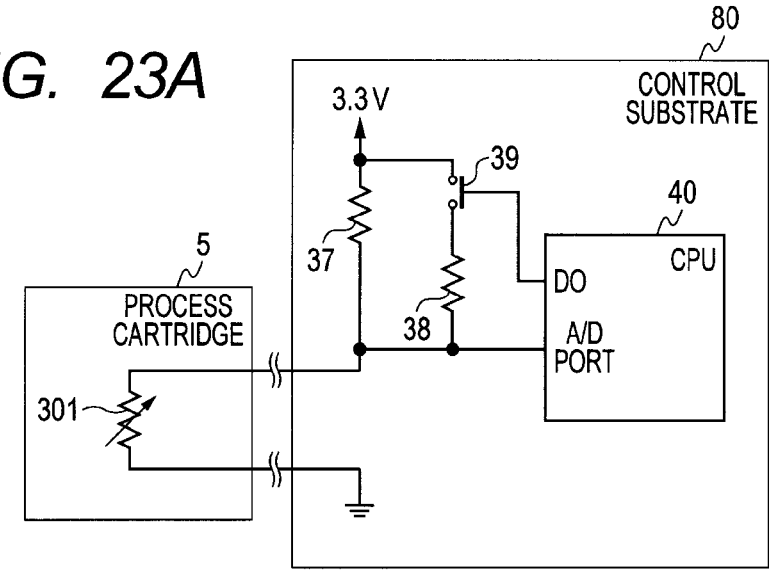
FIG. 23B
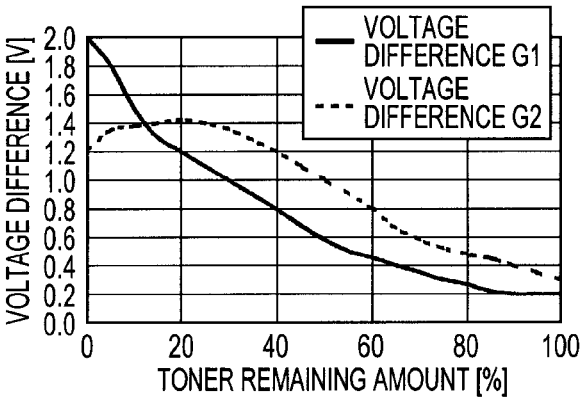
FIG. 23C
TABLE X
| VOLTAGE DIFFERENCE G2 [V] | VOLTAGE DIFFERENCE G1 [V] | TONER REMAINING AMOUNT [%] |
|---|---|---|
| 0.28 | 0.18 | 100 |
| 0.35 A | 0.20 | 95 |
| 0.42 | 0.23 | 90 |
| 0.49 | 0.25 | 85 |
| 0.56 | 0.27 | 80 |
| 0.63 | 0.30 | 75 |
| 0.70 | 0.35 | 70 |
| 0.77 | 0.40 | 65 |
| 0.84 | 0.45 | 60 |
| 0.91 | 0.50 | 55 |
| 0.98 | 0.57 | 50 |
| 1.05 | 0.65 | 45 |
| 1.12 | 0.75 B | 40 |
| 1.19 | 0.85 | 35 |
| 1.26 | 0.95 | 30 |
| 1.33 | 1.10 | 25 |
| 1.40 | 1.20 | 20 |
| 1.40 | 1.45 | 15 |
| 1.33 | 1.55 | 10 |
| 1.28 | 1.80 | 5 |
| 1.19 | 2.00 | 0 |

FIG. 26C TABLE Q

| A/D PORT INPUT VOLTAGE [V] | TEMPERATURE [°C] |
|---|---|
| 2.983 | 0 |
| 2.967 | 1 |
| 2.951 | 2 |
| 2.934 | 3 |
| 2.916 | 4 |
| 2.898 | 5 |
| 2.879 | 6 |
| 2.860 | 7 |
| 2.840 | 8 |
| 2.820 | 9 |
| 2.799 | 10 |
| 2.778 | 11 |
| 2.755 | 12 |
| 2.733 | 13 |
| 2.709 | 14 |
| 2.686 | 15 |
| 2.661 | 16 |
| 2.637 | 17 |
| 2.611 | 18 |
| 2.585 | 19 |
| 2.559 | 20 |
| 2.532 | 21 |
| 2.505 | 22 |
| 2.477 | 23 |
| 2.449 | 24 |
| 2.420 | 25 |
| 2.391 | 26 |
| 2.362 | 27 |
| 2.332 | 28 |
| 2.302 | 29 |
| 2.271 | 30 |
| 2.240 | 31 |
| 2.209 | 32 |
| 2.177 | 33 |
| 2.146 | 34 |
| 2.114 | 35 |
| 2.082 | 36 |
| 2.049 | 37 |
| 2.017 | 38 |
| 1.985 | 39 |
| 1.953 | 40 |
| 1.919 | 41 |
| 1.887 | 42 |
| 1.854 | 43 |
| 1.821 | 44 |
| 1.789 | 45 |
| 1.756 | 46 |
| 1.724 | 47 |
| 1.692 | 48 |
| 1.660 | 49 |
| 1.628 | 50 |

IMAGE FORMING APPARATUS HAVING DEVELOPER AMOUNT DETERMINATION

TECHNICAL FIELD

The present invention relates to detection of a remaining amount of toner which is a developer for an electrophotographic image forming apparatus such as a laser printer, copier, or facsimile machine.

BACKGROUND ART

Conventional image forming apparatuses include an example in which remaining amounts of toner in toner containers are detected using piezoelectric sensors or ultrasonic sensors. For example, a remaining toner amount detection apparatus described in Japanese Patent Application Laid-Open No. H1-6986 includes a piezoelectric sensor installed, with a detection unit of the sensor facing upward, at that position on a bottom face of a hopper near which a thin plate member passes during rotation of an agitation member and detects the remaining amount of toner based on the time during which pressure is detected by the sensor to the time required for one rotation of the agitation member. With the remaining toner amount detection apparatus, when the remaining amount of toner is equal to or larger than a certain amount, output of the piezoelectric sensor is fixed to a Toner Present logic. On the other hand, when the remaining amount of toner is equal to or smaller than a certain amount, the amount of toner cannot be detected and the output of the piezoelectric sensor is fixed to a No Toner logic. However, the detection method disclosed in Japanese Patent Application Laid-Open No. H1-6986 has the following problems. Specifically, when there is a large amount of remaining toner, there is no period of time during which toner weight is not detected, and thus the remaining amount of toner cannot be detected until the toner decreases to a predetermined amount. Also, along with recent increases in the speed of image forming apparatus, when an agitation member operates at high speed, the toner in a toner container whirls up, causing toner to exist at a detection position of the piezoelectric sensor and thereby making it difficult to secure a period of time during which toner weight is not detected.

Conventional image forming apparatuses include one that uses a magnetic permeability sensor to detect the amount of toner in a developing unit. Examples of the apparatus which detects the amount of toner using a magnetic permeability sensor include one described in Japanese Patent Application Laid-Open No. 2002-132036. Japanese Patent Application Laid-Open No. 2002-132036 discloses a toner amount detection apparatus which includes a first agitation blade configured to be flexible and adapted to deform in a direction opposite to a rotational direction when agitating toner, a second agitation blade configured to be rigid and placed behind the first agitation blade in the rotational direction, and a magnetic permeability sensor placed on an outer bottom face of a developing unit. The apparatus detects states of rotating operations of the metal materials placed on the respective agitation blades using the magnetic permeability sensor placed on the outer bottom face of the developing unit. Also, the apparatus is configured such that the first agitation blade and second agitation blade rotate integrally when there is a large amount of toner in the developing unit and that the first agitation blade and second agitation blade rotate separately without deformation when there is a small amount of toner in the developing unit. In so doing, variation in magnetic permeability per rotation of a rotating shaft is measured once using the magnetic permeability sensor when there is a large amount of toner in the developing unit, and twice when there is a small amount of toner in the developing unit. The toner amount detection apparatus detects the amount of toner in the developing unit based on variation in the number of detections.

However, the apparatus disclosed in Japanese Patent Application Laid-Open No. 2002-132036 has the following problem. When there is a large amount of toner, since the first agitation blade and second agitation blade rotate integrally, a signal detected by the magnetic permeability sensor represents one variation in magnetic permeability per rotation of the rotating shaft. On the other hand, when there is a small amount of toner, the first agitation blade hardly deforms and the first and second agitation blades do not rotate integrally. In this case, a signal detected by the magnetic permeability sensor represents two variations in magnetic permeability per rotation of the rotating shaft. In this way, based on the number of magnetic field variations detected by the magnetic permeability sensor (once or twice), the amount of toner is detected alternatively by selecting between a large amount and small amount or between presence and absence. Thus, it is difficult to successively detect the variation in the amount of toner.

CITATION LIST

Patent Literature

PTL1: Japanese Patent Application Laid-Open No. H1-6986

PTL2: Japanese Patent Application Laid-Open No. 2002-132036

SUMMARY OF INVENTION

The present invention has been made in view of the above problems and it is a feature of the present invention to provide an image forming apparatus which can detect a remaining amount of toner successively from a full state to an empty state regardless of whether the amount of toner is large or small using a simple configuration and detect the remaining amount of toner with high accuracy even when an agitation member is operating at high speed.

Another purpose of the invention is to provide an image forming apparatus including a developing unit configured to be detachable from and attachable to the image forming apparatus to contain a developer, a circumduction member adapted to perform a circumduction motion in the developing unit, a pressure detection unit installed on an internal surface of the developing unit and adapted to detect a signal corresponding to pressure in the developing unit which varies with the circumduction motion of the circumduction member; and a determination unit adapted to determine an amount of the developer in the developing unit based on the pressure detected by the pressure detection unit.

A further purpose of the invention is to provide an image forming apparatus including a developing unit configured to be detachable from and attachable to the image forming apparatus to contain a developer, a circumduction member adapted to perform a circumduction motion in the developing unit, a pressure detection unit installed on an internal surface of the developing unit and adapted to detect pressure of being pushed by the circumduction motion of the circumduction member, a measuring section adapted to measure a time period for which the pressure detected by the pressure detection unit varies; and a determination unit adapted to determine an amount of the developer in the developing unit based on the time period measured by the measuring section.

A further purpose of the invention is to provide an image forming apparatus including a developing unit configured to be detachable from and attachable to the image forming apparatus to contain a developer, a circumduction member adapted to perform a circumduction motion in the developing unit, a pressure detection unit installed on an internal surface of the developing unit and adapted to detect pressure of being pushed by the circumduction motion of the circumduction member; and a determination unit adapted to determine an amount of the developer in the developing unit based on the pressure detected by the pressure detection unit.

A further purpose of the invention is to provide an image forming apparatus including a developing unit configured to be detachable from and attachable to the image forming apparatus to contain a developer, a circumduction member adapted to perform a circumduction motion in the developing unit, a pressure detection unit installed on an internal surface of the developing unit and adapted to detect pressure of being pushed by the circumduction motion of the circumduction member via the developer, and a measuring section adapted to measure a time period for which the pressure detected by the pressure detection unit varies, and a determination unit adapted to determine an amount of the developer in the developing unit based on the time period measured by the measuring section.

A further purpose of the invention is to provide an image forming apparatus which a developing unit containing a developer is adapted to be detachable from or attachable to, the image forming apparatus including a circumduction member adapted to perform a circumduction motion in the developing unit, a pressure detection unit installed on an internal surface of the developing unit and adapted to detect pressure of being pushed by the circumduction motion of the circumduction member via the developer, and a determination unit adapted to determine an amount of the developer in the developing unit based on the pressure detected by the pressure detection unit.

A further purpose of the invention is to provide an image forming apparatus including a developing unit configured to be detachable from and attachable to the image forming apparatus to contain a developer, a first circumduction member and a second circumduction member adapted to perform circumduction motions in the developing unit, a pressure detecting unit installed on an internal surface of the developing unit and adapted to detect pressure of being pushed by the circumduction motion of the first circumduction member via the developer or pressure of being pushed by the circumduction motion of the second circumduction member, and a switching unit adapted to switch between a first determination mode and a second determination mode, where the first determination mode is used to determine an amount of the developer in the developing unit based on the pressure of being pushed by the first circumduction member via the developer and the second determination mode is used to determine the amount of the developer in the developing unit based on the pressure of being pushed by the second circumduction member, both the pressure of being pushed by the first circumduction member and the pressure of being pushed by the second circumduction member being detected by the pressure detecting unit.

It is another feature of the present invention to provide an image forming apparatus including a developing unit configured to be detachable from and attachable to the image forming apparatus to contain a developer, a first circumduction member and a second circumduction member adapted to perform circumduction motions in the developing unit, a pressure detecting unit installed on an internal surface of the developing unit and adapted to detect pressure of being pushed by the circumduction motion of the first circumduction member via the developer or pressure of being pushed by the circumduction motion of the second circumduction member, a measuring unit adapted to measure a time period for which the pressure detected by the pressure detecting unit varies, and a switching unit adapted to switch between a first determination mode and a second determination mode, where the first determination mode is used to determine an amount of the developer in the developing unit based on a time period for which the pressure of being pushed by the first circumduction member via the developer varies and the second determination mode is used to determine the amount of the developer in the developing unit based on a time period for which the pressure of being pushed by the second circumduction member varies, the time periods being measured by the measuring unit.

Another purpose of the invention is to provide an image forming apparatus including a first detection member adapted to rotate along with an operation of agitating a developer in a developing unit, a second detection member installed on a rotating shaft of the first detection member at a predetermined angle to the first detection member, a detection unit installed circumferentially on a wall surface of the developing unit along a rotational direction of the first detection member and the second detection member and adapted to detect pressure exerted by the first detection member or the second detection member, and a determination unit adapted to determine an amount of the developer based on the pressure detected by the detecting unit, wherein the determination unit determines the amount of the developer based on a difference between a value detected by the detection unit using the first detection member and a value detected by the detection unit using the second detection member.

A still further purpose of the present invention will become apparent from the following description when taken in conjunction with the accompanying drawings.

BRIEF DESCRIPTION OF DRAWINGS

FIG. 4A shows a characteristic graph of a detection result of a remaining toner amount according to the first embodiment.

FIG. 4B shows a waveform of the detection result of the remaining toner amount according to the first embodiment.

FIG. 4C shows a table T of the detection result of the remaining toner amount according to the first embodiment.

FIGS. 8A, 8B and 8C show sectional views of a developing unit according to a third embodiment.

FIG. 8D shows a characteristic graph of a detection result of a remaining toner amount according to the third embodiment.

FIG. 8E shows a table M of the detection result of the remaining toner amount according to the third embodiment.

FIG. 11A shows a diagram of a circuit adapted to detect variation in resistance value of a force sensor according to a sixth embodiment.

FIG. 11B shows a characteristic graph of a detection result of a remaining toner amount according to the sixth embodiment.

FIG. 11C shows a table X of the detection result of the remaining toner amount according to the sixth embodiment.

FIGS. 13C and 13D show a table Q of the detection result of the remaining toner amount according to the seventh embodiment.

FIG. 18A shows a characteristic graph according to the eighth, ninth and thirteenth embodiments.

FIG. 18B shows a waveform according to the eighth, ninth and thirteenth embodiments.

FIG. 18C shows a table T according to the eighth, ninth and thirteenth embodiments.

FIG. 21A shows a characteristic graph according to the tenth and eleventh embodiments.

FIG. 21B shows a waveform according to the tenth and eleventh embodiments.

FIG. 21C shows a table N according to the tenth and eleventh embodiments.

FIG. 23A shows a diagram of a circuit adapted to detect variation in resistance value of the force sensor according to the twelfth embodiment.

FIG. 23B shows a characteristic graph of the force sensor according to the twelfth embodiment.

FIG. 23C shows a table X of resistance values of the force sensor according to the twelfth embodiment.

FIG. 26C shows a table Q according to the thirteenth embodiment.

DESCRIPTION OF EMBODIMENTS

Configuration and operation of the present invention will be described below. However, note that the embodiments described below are only exemplary and not intended to limit the technical scope of the present invention only to the embodiments. Now, embodiments of the present invention will be described in detail below with reference to the accompanying drawings.

A first embodiment will be described below.

Configuration of Image Forming Apparatus

Figure 1:
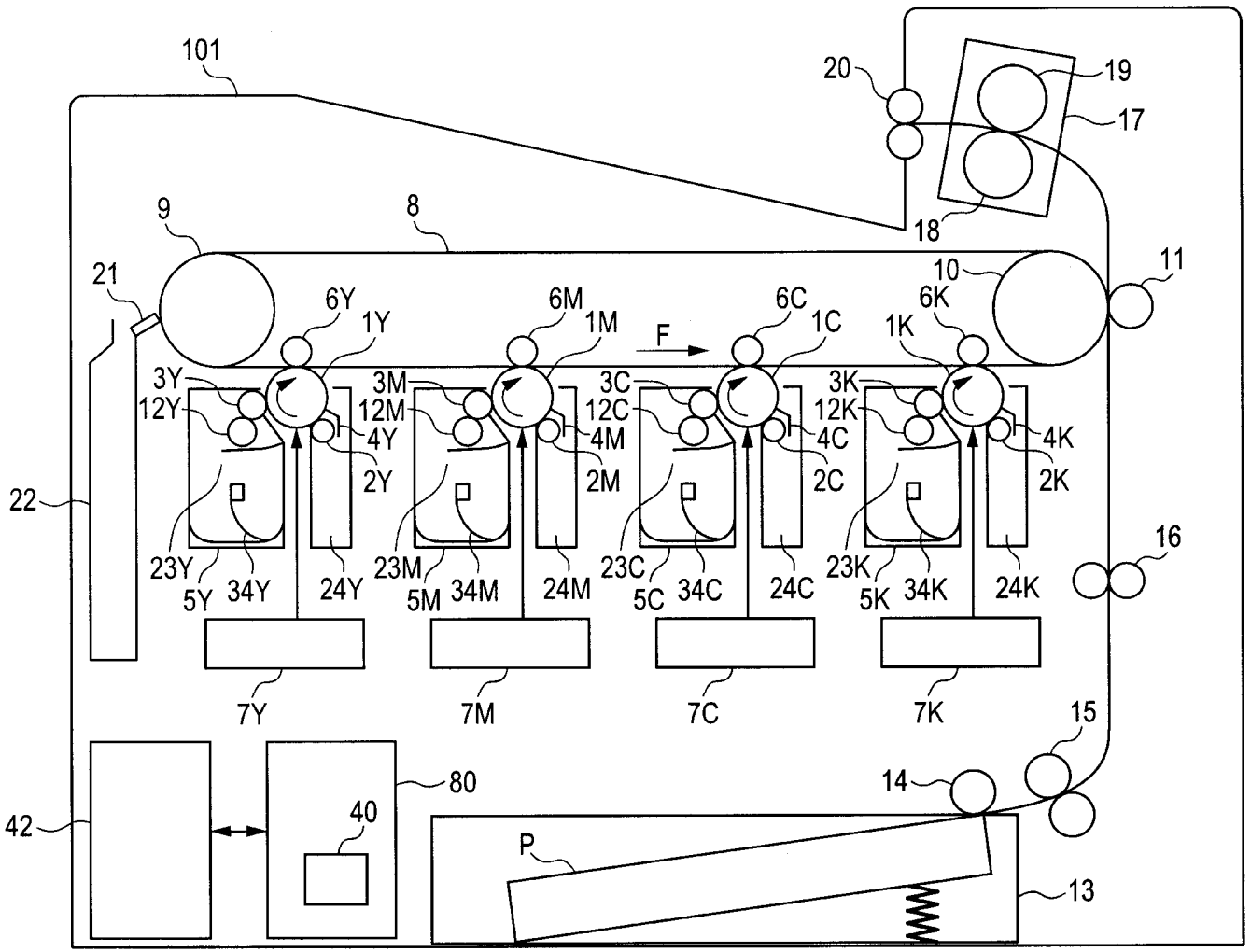
FIG. 1 shows a sectional view showing a configuration of a color laser printer according to a first embodiment.

FIG. 1 is a configuration diagram of a color laser printer included in the present embodiment. The color laser printer (hereinafter referred to as a main body) shown in FIG. 1 includes process cartridges 5Y, 5M, 5C and 5K attachable/detachable to/from the main body 101. The four process cartridges 5Y, 5M, 5C and 5K are identical in structure, but different in toner color. That is, the process cartridges 5Y, 5M, 5C and 5K are used to form yellow (Y), magenta (M), cyan (C) and black (K) toner images, respectively. Hereinafter, 5Y, 5M, 5C and 5K may be collectively referred to as 5. Each process cartridge 5 is made up of three components: a developing unit, image forming unit and waste toner unit. The developing unit includes a developing roller 3, toner replenishing roller 12, toner container 23 and agitating member 34. The agitating member 34 is 150 μm thick. On the other hand, the image forming unit includes a photosensitive drum 1 and charge roller 2, where the photosensitive drum 1 is an image bearing member. The waste toner unit includes a cleaning blade 4 and waste toner container 24.

Laser units 7 adapted to expose the respective photosensitive drums 1 based on an image signal are placed below the respective process cartridges 5. The photosensitive drums 1 are charged to a predetermined potential of negative polarity by the respective charge rollers 2, and then electrostatic latent images are formed on the respective photosensitive drums 1 by the respective laser units 7. The electrostatic latent images are reversal-developed by the developing rollers 3, and then toners of negative polarity adhere to the electrostatic latent images to form Y, M, C and K toner images, respectively. An intermediate transfer belt unit includes an intermediate transfer belt 8, drive roller 9 and secondary transfer counter roller 10. Also, primary transfer rollers 6 are disposed inside the intermediate transfer belt 8, facing the respective photosensitive drums 1, and a transfer bias is applied to the primary transfer rollers 6 by a bias application unit (not shown).

The toner images formed on the photosensitive drums 1 rotate in the direction of arrows indicated on the photosensitive drums 1 while the intermediate transfer belt 8 rotates in the direction of arrow F. Furthermore, as a positive bias is applied to the primary transfer rollers 6 by the bias application unit (not shown), the toner images undergo primary transfer to the intermediate transfer belt 8 one after another beginning with the toner image on the photosensitive drum 1Y, and the toner images of four colors are transported to a secondary transfer roller 11, being superimposed on each other. A feed/transport apparatus includes a paper feed roller 14 adapted to feed transfer material P from a paper feed cassette 13 containing the transfer material P and a transport roller pair 15 adapted to transport the fed transfer material P. The transfer material P transported from the feed/transport apparatus is transported to the secondary transfer roller 11 by a registration roller pair 16.

During transfer from the intermediate transfer belt 8 to the transfer material P, as a positive bias is applied to the secondary transfer roller 11, the toner images of four colors undergo secondary transfer from the intermediate transfer belt 8 to the transfer material P. After the toner images are transferred, the transfer material P is transported to a fixing apparatus 17 and heated and pressed there by a fixing film 18 and pressure roller 19, and consequently the toner images are fixed to a surface of the transfer material P. After the fixing, the transfer material P is discharged by a paper output roller pair 20. On the other hand, the toner remaining on the surfaces of the photosensitive drums 1 is removed by the cleaning blades 4 and collected in the waste toner containers 24. Also, the toner remaining on the intermediate transfer belt 8 after the secondary transfer to the transfer material P is removed by a transfer belt cleaning blade 21 and collected in a waste toner container 22. Also, an electrical circuit used to control the main body is mounted on a control substrate 80. A single-chip microcomputer (hereinafter referred to as a CPU) 40 is mounted on the control substrate 80. The CPU 40 performs comprehensive control over operations of the main body, including control of a driving source (not shown) for transport of the transfer material P and a driving source (not shown) for the process cartridges as well as control related to image formation and control related to fault detection. A video controller 42 controls laser emission in the laser units based on image data. Besides, the video controller 42 interfaces with a user via a control panel (not shown). The control panel displays the remaining amount of toner of each color as a bar graph.

Configuration of Developing Unit

Figure 2A:
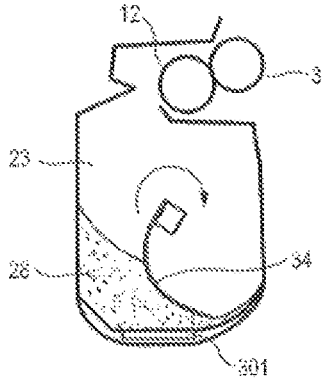
FIG. 2A shows a sectional view of a developing unit according to the first embodiment.

FIG. 2A is a sectional view of a developing unit included in the process cartridge. A force sensor 301 in the developing unit functions as a remaining amount sensor of toner 28 which is a developer. The force sensor 301 according to the present embodiment includes a single layer of a wiring pattern and layer of conductive ink, and a spacer is placed peripherally between the layers to form a space (gap). The force sensor 301 is configured such that when a top face of a sensing surface is pushed, a conductive ink surface on the top face deforms, coming into contact with the wiring pattern on a bottom face. With this configuration, a resistance value varies with the contact area corresponding to pressure of the push. A force sensor (CP1642) 301 made by IEE is used according to the present embodiment.

Figure 2B:
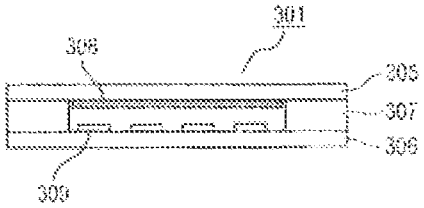
FIGS. 2B, 2C and 2D show sectional views of a force-sensitive resister sensor (hereinafter referred to as "force sensor") according to the first embodiment.

FIG. 2B is a sectional view of the force sensor 301 serving as a pressure sensitive element adapted to detect pressure in the present embodiment. A sheet 305 and sheet 306 are sheet-like members. A spacer 307 forms a space (gap) between the sheet 305 and sheet 306. Conductive ink 308 is provided on the underside of the sheet 305. Electrode patterns 309 are formed on the sheet 306. A top face of the sheet 305 provides a sensing surface. When the sensing surface is pushed, the top face of the sheet 305 deforms, coming into contact with the electrode patterns 309 located below.

Figure 2C:
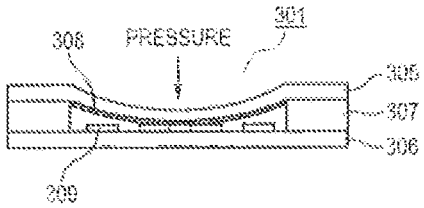
Figure 2D:
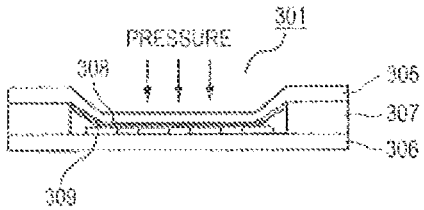

FIG. 2C shows a state in which a low pressure is applied to the sensing surface of the force sensor 301. Two electrode patterns in the center are in contact with the conductive ink 308. FIG. 3D shows a state in which a high pressure is applied to the sensing surface of the force sensor 301. Four electrode patterns are in contact with the conductive ink 308. Furthermore, contact areas of the electrode patterns are increased in a longitudinal direction as well. The force sensor 301 has such a property that the magnitude of pressure is inversely proportional to the resistance value. Also, the force sensor 301 is configured such that a detection unit and electric wires will be formed integrally. The detection unit is fixedly bonded to an inner part (internal surface of the developing unit) of the toner container 23 containing the toner 28 along a turning direction (direction of arrow in FIG. 2A) of the agitating member 34 such that the sheet 305 will face toward the inner side of the toner container 23. Also, the electric wires are led out of the developing unit and an exit hole is sealed tightly. The force sensor 301 is connected to the main body 101 via two electrodes (not shown). The electrodes come into contact when the process cartridge 5 is attached to the main body 101. As shown in FIG. 2A, when the agitating member 34 serving as a first circumduction member rotates, the agitating member 34 encounters resistance from the toner 28 agitated by the agitating member 34 and deflects greatly by deforming in a direction opposite to a rotational direction. When there is a large amount of remaining toner 28, the length of time the agitating member 34 passes above the force sensor 301 increases, increasing the length of time pressure is exerted on the sensing surface of the force sensor 301. On the other hand, when there is a small amount of remaining toner 28, the resistance of the toner 28 decreases, decreasing an amount of deflection of the agitating member 34. This reduces the length of time the agitating member 34 passes above the force sensor 301, reducing the length of time pressure is exerted on the sensing surface of the force sensor 301. The remaining amount of toner 28 is detected based on this principle.

Figure 3:
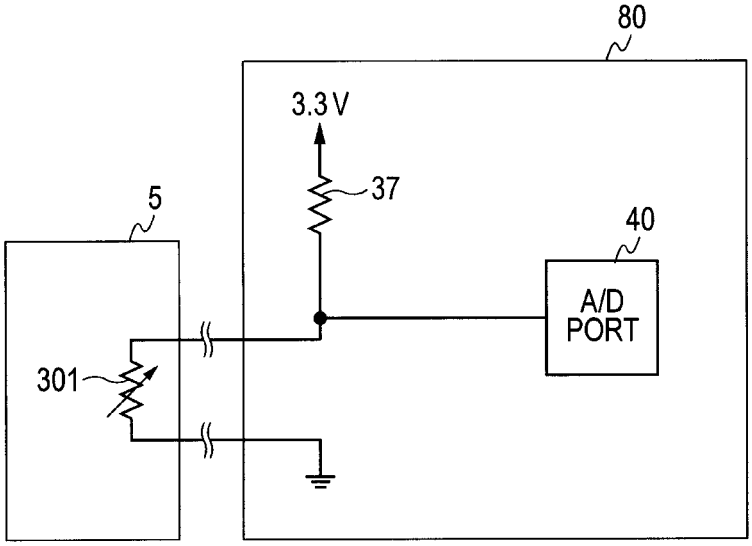
FIG. 3 shows a diagram of a circuit adapted to detect variation in resistance value of the force sensor according to the first embodiment.

FIG. 3 is a diagram of a circuit adapted to detect variation in the resistance value of the force sensor 301. A supply voltage of 3.3 VDC is divided between the force sensor 301 and a voltage dividing-resistor 37, and a resulting signal is input in an A/D port of the CPU 40.

Next, detection characteristics of remaining amount detection of toner 28 according to the present embodiment will be described with reference to FIG. 4. FIG. 4A is a characteristic graph of the remaining amount of toner 28 versus sensor on-time of the force sensor 301. FIG. 4B is waveform data obtained when the remaining amount of toner 28 is 16%. The force sensor 301 is on for 8 msec. FIG. 4C is a table T which represents the characteristic graph of FIG. 4A in tabular form. Remaining amounts of toner 28 in between numerical values listed in the table are found by linear interpolation based on known remaining amounts of toner 28. This is also true of the subsequent tables. The values of time calculated here are those according to the present embodiment, and thus calculated values of time will change under different conditions. This is also true of numerical values in the table used to determine the remaining amount of toner 28.

Remaining Toner Amount Detection Sequence

Figure 5:
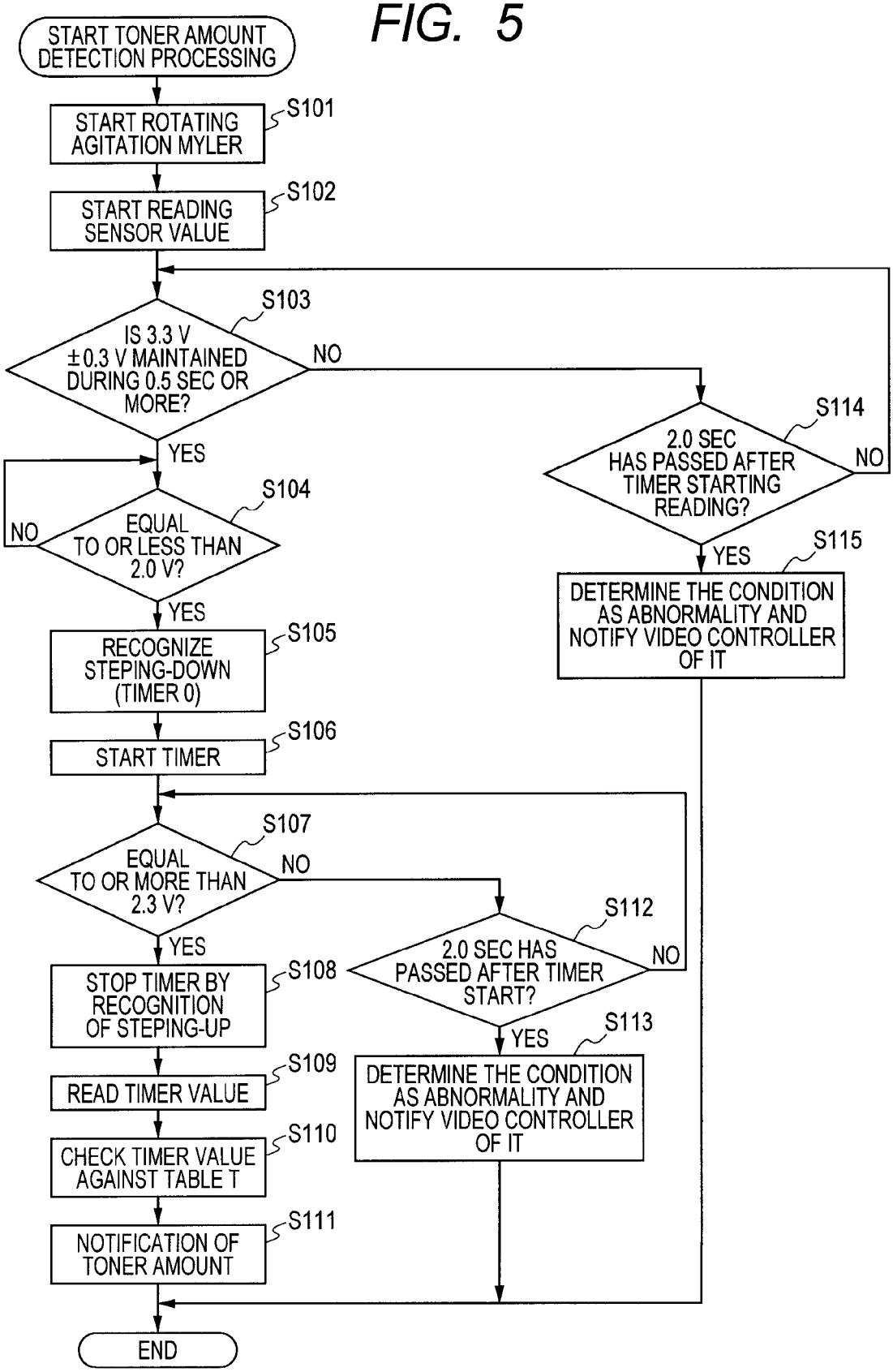
FIG. 5 shows a flowchart of a detection result of a remaining toner amount according to the first embodiment.

A flow of remaining amount detection of toner 28 according to the present embodiment will be described with reference to a flowchart in FIG. 5. The processes in the flowchart are performed by the CPU 40, and so are the processes in the flowcharts according to the subsequent embodiments. However, this is not restrictive. For example, if an application-specific integrated circuit (ASIC) is mounted in the image forming apparatus, functions of some of the steps (hereinafter expressed by S) may be borne by the ASIC.

First, the CPU 40 causes the agitating member 34 to start rotating (S101). The CPU 40 monitors an A/D input port of the CPU 40 and starts reading sensor values (S102). To detect an initial value with no pressure applied to the force sensor 301, the CPU 40 monitors whether a voltage of 3.3 V±0.3 V is maintained for 0.5 seconds or more (S103). According to the present embodiment, a period of the agitating member 34 is approximately 1 second. Therefore, if a voltage of 3.3 V±0.3 V is not maintained for 0.5 seconds or more in S103 (No in S103) and 2.0 seconds or more passes after the start of reading (Yes in S114), the CPU 40 determines that something is wrong with the force sensor 301 and notifies the video controller 42 thereof (S115). If a voltage of 3.3 V±0.3 V is maintained for 0.5 seconds or more in S103, the CPU 40 determines that operation is normal. Consequently, the CPU 40 monitors the A/D input port of the CPU 40. When the voltage falls to or below 2.0 V (Yes in S104), the CPU 40 recognizes a fall of the sensor signal and initializes a timer (not shown) to 0 (S105). Then, the CPU 40 starts the timer to measure a time period (S106). Next, the CPU 40 monitors the A/D input port of the CPU 40. When the voltage rises to or above 2.3 V (S107), the CPU 40 recognizes a rise of the signal and stops the timer (S108). The reason why a fall threshold is set to 2.0 V and a rise threshold is set to 2.3 V is to provide hysteresis and thereby prevent noise-induced malfunctions.

Next, the CPU 40 reads the timer value (S109) and refers to the table T (S110). Then, the CPU 40 notifies the video controller 42 of the remaining amount of toner 28 (toner amount) looked up in the table (S111). If it is determined in S107 that the voltage is below 2.3 V and 2.0 seconds or more passes after the start of the timer (Yes in S112), the CPU 40 determines that something is wrong and notifies the video controller 42 thereof (S113). In this way, the remaining amount of toner 28 is detected successively during the time period in which pressure is detected by the force sensor 301. Although the sequence used in the above example involves detecting the falling edge of the signal from the force sensor 301 after the CPU 40 detects that output has stabilized at 3.3 V, a fall may be detected a predetermined time after the agitating member 34 starts rotating. According to the present embodiment, voltage values are detected at the A/D input port of the CPU 40. However, by digitalizing data using a voltage detection circuit made up of a comparator or the like, the time period may be detected at a digital port. Also, since it is sufficient if the time period for which pressure is detected can be measured, a sheet switch (membrane switch) (described in a seventh embodiment) or a general-purpose pressure sensor may be used instead of the force sensor 301, where the sheet switch is a switching element.

With the above configuration and operation, the present embodiment provides the following advantages. First, since the remaining amount of toner 28 is detected during the time period in which pressure is detected by the force sensor 301, the remaining amount of toner 28 can be detected successively from full to empty. Second, the use of the force sensor 301 can simplify the detection circuit and quick response time of the force sensor 301 can speed up detection time. Furthermore, since backward bending of the agitating member 34 is stable depending on the remaining amount of toner 28 even when the agitating member 34 is rotating at high speed, the remaining amount of toner 28 can be detected simultaneously with an image forming operation.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

Next, a second embodiment will be described below.

In the first embodiment, the remaining amount of toner 28 is detected based on the period of time for which pressure is detected by the force sensor 301. According to the present embodiment, the CPU 40 detects the remaining amount of toner 28 based on output voltage variation detected by measuring resistance value variation corresponding to the pressure being detected by the force sensor 301. First, a color laser printer included in the present embodiment will be described. It is assumed that the configurations in FIGS. 1, 2 and 3 described in the first embodiment are also applied to the present embodiment. Also, the same components as those in the first embodiment are denoted by the same reference numerals as the corresponding components in the first embodiment, and description thereof will be omitted.

Figures 6A, 6B:
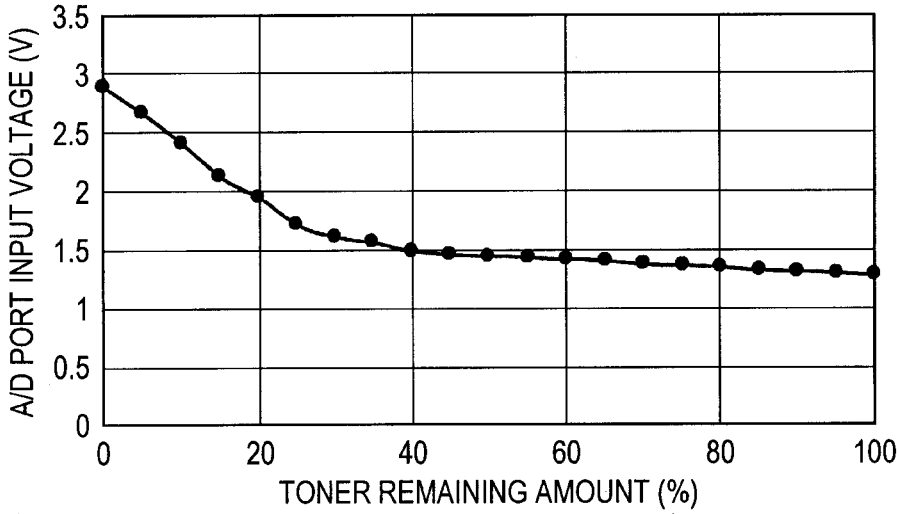
FIG. 6A shows a characteristic graph of a detection result of a remaining toner amount according to a second embodiment.
FIG. 6B shows a table N of the detection result of the remaining toner amount according to the second embodiment.

Next, detection characteristics of remaining amount detection of toner 28 according to the present embodiment will be described with reference to FIG. 6. FIG. 6A is a characteristic graph of the remaining amount (%) of toner 28 versus A/D port input voltage (V) produced by voltage division between the force sensor 301 and voltage dividing-resistor 37. FIG. 6B is a table N showing correspondence between the A/D port input voltage (V) and remaining toner amount (%). The voltage output values calculated here are those according to the present embodiment, and thus calculated voltage output values will change under different conditions. This is also true of numerical values in the table used to determine the remaining amount of toner 28.

Sequence of Toner Amount Detection Process

Figure 7:
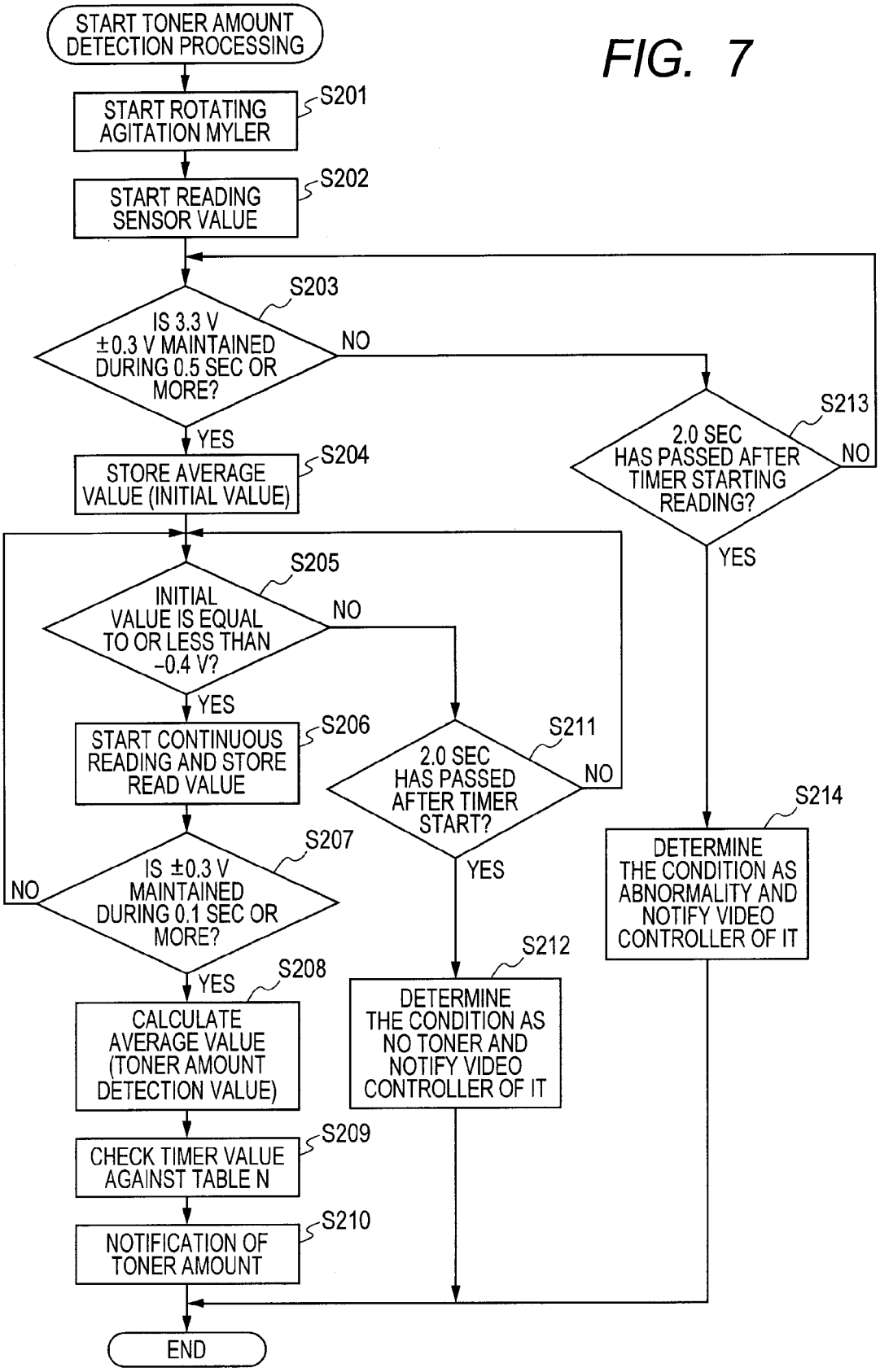
FIG. 7 shows a flowchart of remaining toner amount detection according to the second embodiment.

Next, a flow of remaining amount detection of toner 28 according to the present embodiment will be described with reference to a flowchart in FIG. 7. In the present embodiment, S201 to S203, S213, and S214 are the same as S101 to S103, S114, and S115 in FIG. 5 according to the first embodiment, and thus description thereof will be omitted. If a voltage of 3.3 V±0.3 V is maintained for 0.5 seconds or more in S203, the CPU 40 stores an average value over this period in memory (not shown) by regarding the average value as an initial value (S204). Next, to detect whether a pressure starts to be applied to the force sensor 301, the CPU 40 monitors whether the initial value falls to or below the initial value minus 0.4 V (S205). If the voltage remains above the initial value minus 0.4 V (No in S205) and a voltage of 3.3 V±0.3 V is maintained for 2.0 seconds or more (Yes in S211), the CPU 40 determines that the toner has run out and notifies the video controller 42 thereof (S212). If the voltage falls to or below the initial value minus 0.4 V during monitoring in S205, the CPU 40 recognizes that a pressure has started to be applied to the force sensor 301 and starts continuous reading and stores the read values in a memory or the like (not shown) (S206). If a value equal to or lower than the initial value minus 0.4 V is maintained within ±0.3 V for 0.1 second (Yes in S207), the CPU 40 determines that the value is normal, calculates an average value as a detected value of the toner amount (S208), and refers to the table N for a corresponding value (S209). Then, the CPU 40 notifies the video controller 42 of the remaining amount of toner 28 looked up in the table (S210). In this way, the CPU 40 detects the remaining amount of toner 28 successively using voltage output produced based on resistance value variation corresponding to the pressure detected by the force sensor 301.

With the above configuration and operation, the present embodiment provides the following advantages. Although the time period detection described in the first embodiment provides sufficient accuracy, as described in the present embodiment, the use of the voltage output produced based on resistance value variation corresponding to the detected pressure allows the remaining amount of toner 28 to be detected with higher accuracy even when the remaining amount is 20% or less. Besides, by switching between two modes of control, the remaining amount of toner 28 down to approximately 20% may be detected using the detection control according to the first embodiment and the remaining amount of toner 28 smaller than approximately 20% may be detected using the detection control according to the present embodiment. This will allow the remaining amount of toner 28 to be detected with still higher accuracy in any amount range from 0% to 100% than when one of the control modes is used alone.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

Next, a third embodiment will be described below.

First, differences from the first and second embodiments will be described. In the first and second embodiments, the agitating member 34 applies pressure to the force sensor 301 via the toner 28. In addition to the agitating member 34, the present embodiment includes a sensing member 351 serving as a second circumduction member configured to be more flexible. The sensing member 351 combines a detection system: when there is a small amount of remaining toner 28, the sensing member 351 directly applies pressure to the force sensor 301 and detects the time period of pressure application to detect the remaining amount of toner 28.

A color laser printer included in the present embodiment will be described. It is assumed that the configurations in FIGS. 1 and 3 and flowchart in FIG. 5 described in the first embodiment are also applied to the present embodiment. However, the wording of S110 in the flowchart of FIG. 5 is changed to "refer to table M." Also, the same components as those in the first and second embodiments are denoted by the same reference numerals as the corresponding components in the first and second embodiments, and description thereof will be omitted.

FIG. 8A is a sectional view of the developing unit in the process cartridge 5 according to the present embodiment. When compared to the configuration of the developing unit according to the first and second embodiments, the sensing member 351 highly flexible and about half as thick as the agitating member 34 has been added. In order to have an agitation function, the agitating member 34 needs to be wide enough to cover the entire developing unit in the longitudinal direction. However, the sensing member 351 can be either wide enough to cover the entire developing unit in the longitudinal direction or wide enough to cover only the detection unit of the force sensor 301. FIG. 8A is a sectional view of the developing unit when there is a large amount of remaining toner 28 and FIG. 8B is a sectional view of the developing unit when there is a small amount of remaining toner 28. When there is a large amount of remaining toner 28 as shown in FIG. 8A, the sensing member 351 performs a circumduction motion coaxially with the agitating member 34 in the toner container 23 without contact with the force sensor 301. On the other hand, when there is a small amount of remaining toner 28 as shown in FIG. 8B, the sensing member 351 performs a circumduction motion in the toner container 23 by coming into contact with the force sensor 301. FIG. 8C is a perspective view showing a positional relationship between the sensing member 351 and force sensor 301. The longitudinal width of the sensing member 351 corresponds to the width of the sensing surface of the force sensor 301. On the other hand, the longitudinal width of the agitating member 34, which needs to agitate all the toner 28 in the toner container, covers the entire longitudinal range.

FIG. 8D is a characteristic graph of the remaining amount (%) of toner 28 versus sensor on-time (ms) during which the sensing member 351 is applying pressure directly to the force sensor 301. FIG. 8E is a table M which represents the characteristic graph of FIG. 8E in tabular form. The values of time calculated here are those according to the present embodiment, and thus calculated values of time will change under different conditions. This is also true of numerical values in the table M used to determine the remaining amount of toner 28. As in the case of the second embodiment, in the present embodiment, the remaining amount of toner 28 down to approximately 30%, which is a predetermined amount, is detected using the detection control according to the first embodiment (first determination mode). Then, by switching the control, the remaining amount of toner 28 smaller than approximately 30%, which is lower than the predetermined amount, is detected using the detection control according to the present embodiment (second determination mode). This allows the remaining amount of toner 28 to be detected with still higher accuracy in any amount range from 0% to 100% than when one of the control modes is used alone.

With the above configuration and operation, the present embodiment provides the following advantage similar to that of the second embodiment. That is, when the remaining amount of toner 28 falls below approximately 30%, the remaining amount of toner 28 is detected through detection of output voltage variation which is based on the resistance value corresponding to the pressure of the sensing member 351 pushing the force sensor 301. This allows the remaining amount of toner 28 to be detected with improved accuracy.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

A fourth embodiment will be described below.

The fourth embodiment differs from the first embodiment in that the present embodiment uses the detection method according to the first embodiment when there is a large amount of remaining toner 28 and switches to the detection method according to the present embodiment when the amount of remaining toner 28 is decreased. When the amount of remaining toner 28 is decreased, the present embodiment switches to control which involves detecting the remaining amount of toner 28 by detecting output voltage variation which is based on the resistance value variation corresponding to the pressure applied to the force sensor 301 by the sensing member 351.

First, a color laser printer included in the present embodiment will be described. It is assumed that the configurations in FIGS. 1, 3, and 8A and flowchart in FIG. 7 described in any of the first to third embodiments are also applied to the present embodiment. However, the wording of S209 in the flowchart of FIG. 7 is changed to "refer to table T." Also, the same components as those in the first to third embodiments are denoted by the same reference numerals as the corresponding components in the first to third embodiments, and description thereof will be omitted.

Figures 9A, 9B:
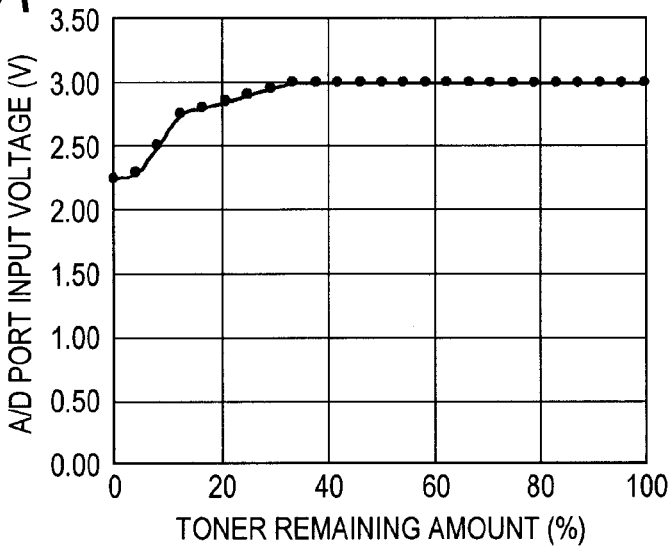
FIG. 9A shows a characteristic graph of a detection result of a remaining toner amount according to a fourth embodiment.
FIG. 9B shows a table T of the detection result of the remaining toner amount according to the fourth embodiment.

Next, detection characteristics of remaining amount detection of toner 28 according to the present embodiment will be described with reference to FIGS. 9A and 9B. FIG. 9A is a characteristic graph of the remaining amount (%) of toner 28 versus A/D port input voltage (V) produced by voltage division between the force sensor 301 and voltage dividing-resistor 37. FIG. 9B is a table T which represents the characteristic graph of FIG. 9A in tabular form. The voltage output values calculated here are those according to the present embodiment, and thus calculated values of time will change under different conditions.

By switching between two modes of control, the remaining amount of toner 28 down to approximately 20% is detected using the detection control according to the first embodiment and the remaining amount of toner 28 smaller than approximately 20% is detected using the detection control according to the present embodiment. This allows the remaining amount of toner 28 to be detected with higher accuracy in any amount range from 0% to 100% than when one of the control modes is used alone.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

A fifth embodiment will be described below.

Figure 10A:
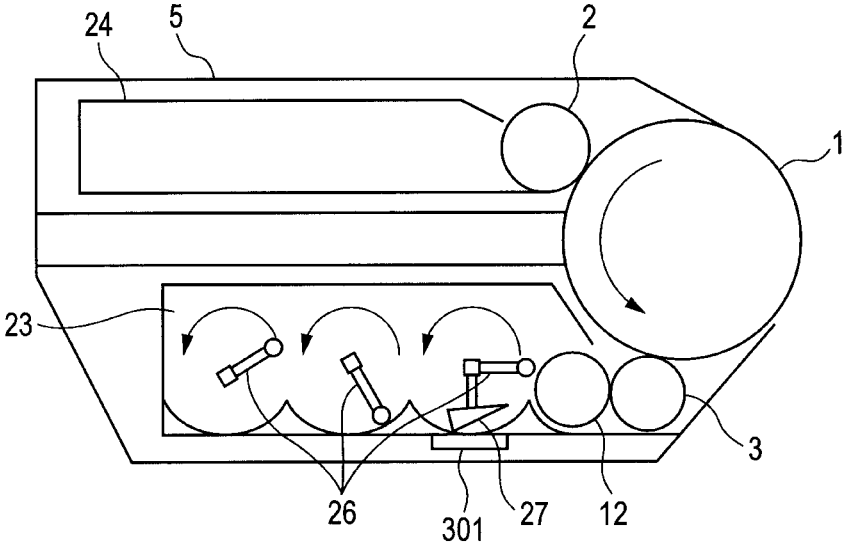
FIGS. 10A and 10B show sectional views of a developing unit according to a fifth embodiment.
Figure 10B:
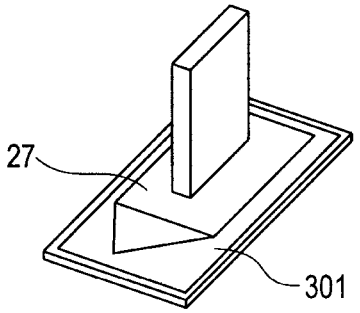

In the first embodiment, the agitating member 34 has flexibility and the remaining amount of toner 28 is detected based on the period of time for which pressure is detected by the force sensor 301 via the toner 28 based on the backward bending of the agitating member 34. In the present embodiment, an application example in which the agitation member is a rigid body will be described. According to the present embodiment, a rigid triangular prism for detection of the remaining amount of toner 28 rotates coaxially with a shaft of an agitation bar and pushes the toner 28 by a slope of the triangular prism, and the remaining amount of toner 28 is detected through detection of output voltage variation which is based on resistance value corresponding to the pressure being detected by the force sensor 301. First, the process cartridge 5 included in the present embodiment will be described with reference to FIGS. 10A and 10B. FIG. 10A is a sectional view of the process cartridge 5 according to the present embodiment. The same components as those in the first embodiment are denoted by the same reference numerals as the corresponding components in the first embodiment, and description thereof will be omitted. An agitation bar 26 agitates the toner 28 by performing a rotary motion around a rotating shaft. A toner pushing member 27 has a shape of a triangular prism and performs a rotary motion coaxially with the agitation bar 26. The flowchart and detection characteristics are similar to those of the first embodiment. FIG. 10B is a perspective view showing a positional relationship between the force sensor 301 and the toner pushing member 27 which has a shape of a triangular prism. With the above configuration and operation, the present embodiment is applicable even when the agitation member is a rigid body such as a metal bar.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

A sixth embodiment will be described below.

The sixth embodiment differs from the first embodiment in that control which involves switching between voltage dividing-resistors is added to increase accuracy when the amount of remaining toner 28 is decreased. First, a color laser printer included in the present embodiment will be described. It is assumed that the configurations in FIGS. 1 and 2 described in the first and second embodiments are also applied to the present embodiment. Also, the same components as those in the first embodiment are denoted by the same reference numerals as the corresponding components in the first embodiment, and description thereof will be omitted. FIG. 11A is a diagram of a circuit adapted to detect variation in resistance value of the force sensor 301. The circuit is configured such that an analog switch 39 is turned on and off from a digital output port DO of the CPU 40. When the analog switch 39 is turned on, a fixed resistor 38 is connected in parallel to the voltage dividing-resistor 37, changing a voltage divider ratio of the voltage dividing-resistor 37 to the force sensor 301.

Next, detection characteristics of remaining amount detection of toner 28 according to the present embodiment will be described with reference to FIGS. 11B and 11C. G1(V) in FIG. 11B is a characteristic graph of the remaining amount of toner 28 versus A/D port input voltage obtained by voltage division between the force sensor 301 and voltage dividing-resistor 37. On the other hand, G2(V) in FIG. 11B is a characteristic graph of the remaining amount of toner 28 versus A/D port input voltage obtained by voltage division between the force sensor 301 and the voltage dividing-resistor 37 connected in parallel with the fixed resistor 38. FIG. 11C is a table X which represents the characteristic graph of FIG. 11B in tabular form. The voltage values calculated here are those according to the present embodiment, and thus calculated values of time will change under different conditions. This is also true of voltage values in the table used to determine the remaining amount of toner 28.

When there is a large amount of remaining toner 28, the CPU 40 sets a DO port output to Low. When a new process cartridge 5 is used beginning with a remaining amount of toner 28 of 100%, changes take place with use in a direction indicated by arrow A in FIG. 11C. Next, when the remaining amount of toner 28 becomes 30%, the CPU 40 changes the DO port output to High and thereby turns on the analog switch 39. Consequently, the fixed resistor 38 is connected in parallel to the voltage dividing-resistor 37 to switch the sensitivity, causing the output voltage to change from G1(V) to G2(V). As a result, changes take place in a direction indicated by arrow B. If the sensitivity is not switched, changes take place according to the characteristics of the output voltage G1(V). Consequently, the amount of voltage change during the period when the remaining amount is between 0% and 30% is 1.286V. If the sensitivity is switched, a switch occurs to the characteristics of the output voltage G2(V). Consequently, the amount of voltage change during the period when the remaining amount is between 0% and 30% increases to 1.515 V, increasing the resolution for detecting the remaining amount of toner 28.

Remaining Toner Amount Detection Sequence

Figure 12:
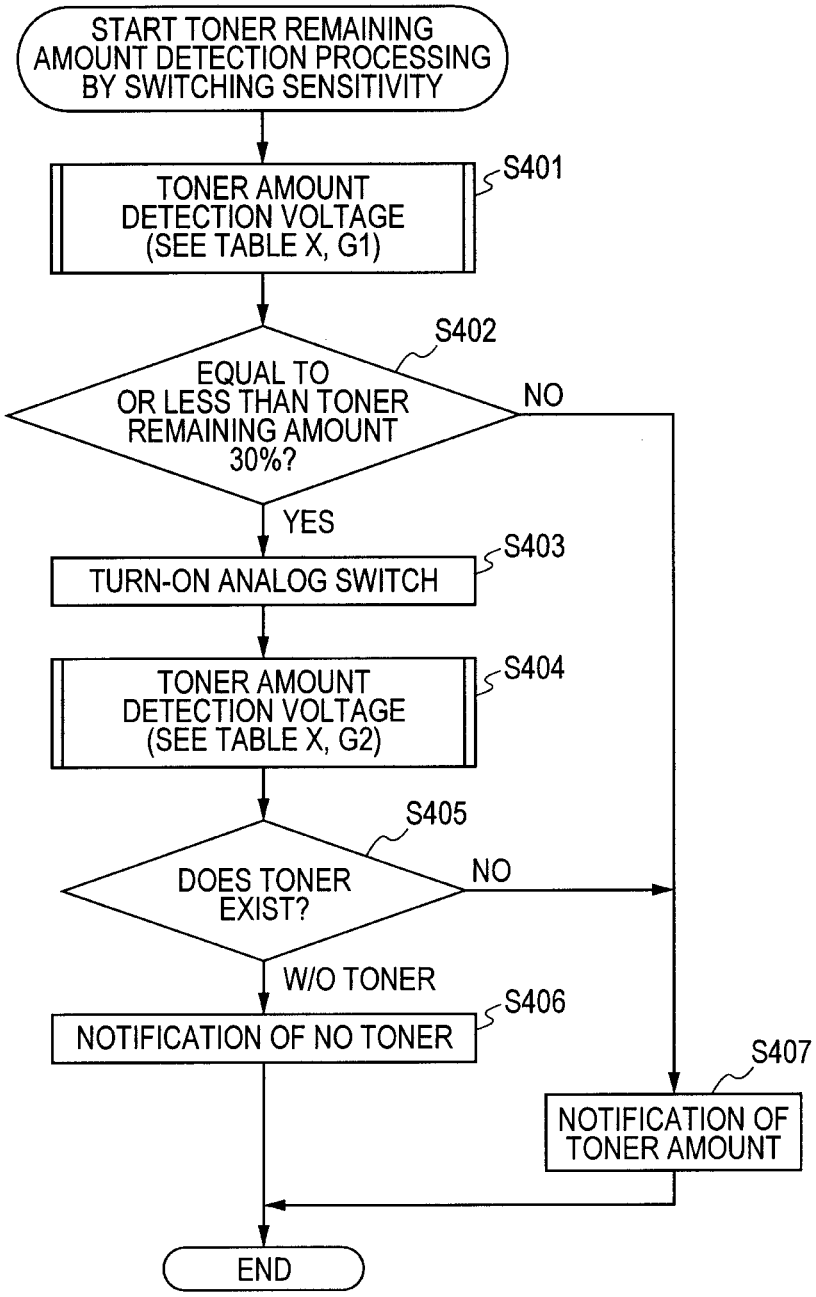
FIG. 12 is a flowchart of remaining toner amount detection according to the sixth embodiment.

FIG. 12 is a flowchart of a remaining toner amount detection process based on sensitivity switching according to the present embodiment. First, based on the flowchart described in FIG. 7, the CPU 40 detects the remaining amount of toner 28 (S401). However, in S209 of FIG. 7, the CPU 40 refers to the output voltage G1(V) in the table X of FIG. 11C. The CPU 40 determines whether the remaining amount of toner 28 is 30% or less (S402). If the remaining amount of toner 28 is larger than 30%, the CPU 40 notifies the video controller 42 of the remaining amount of toner 28 (S407) and thereby finishes the process. If it is determined in S402 that the remaining amount of toner 28 is 30% or less, the CPU 40 turns on the analog switch 39 (S403). Subsequently, the CPU 40 detects the remaining amount of toner 28 again based on the flowchart described in FIG. 7 (S404). However, in S209 of FIG. 7, the CPU 40 refers to the output voltage G2(V) in the table X of FIG. 11C. The CPU 40 determines whether the toner has run out (S405). If the toner has run out, the CPU 40 notifies the video controller 42 of the out-of-toner condition (S406) and thereby finishes the process. On the other hand, if there is remaining toner 28, the CPU 40 notifies the video controller 42 of the remaining amount of toner 28 (S407) and thereby finishes the process.

Again in the present embodiment, by switching between two modes of control, the remaining amount of toner 28 down to approximately 30% is detected using the detection control according to the first embodiment and the remaining amount of toner 28 smaller than approximately 30% is detected using the detection control according to the present embodiment. This allows the remaining amount of toner 28 to be detected with still higher accuracy in any amount range from 0% to 100% than when one of the control modes is used alone.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

A seventh embodiment will be described below.

Figure 13A:
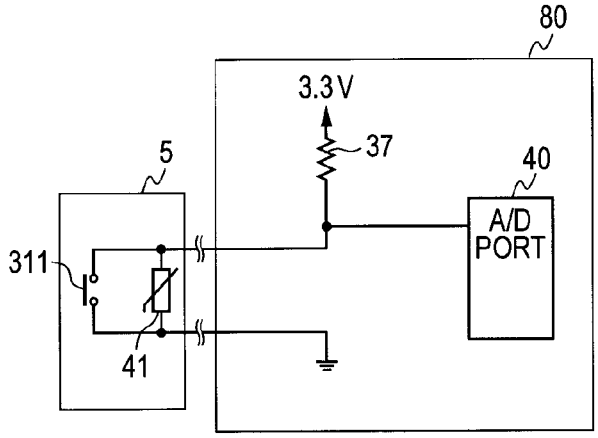
FIG. 13A shows a diagram of a circuit adapted to detect variation in resistance value of a force sensor according to a seventh embodiment.

There are two differences from the first embodiment. The first difference lies in that whereas in the first embodiment, the remaining amount of toner 28 is detected based on the period of time for which pressure is detected by the force sensor 301, in the present embodiment, the remaining amount of toner 28 is detected through detection of the time period for which pressure is detected by a sheet switch 311 (FIG. 13A). The second difference lies in that temperature of the process cartridge 5 is detected during a period in which pressure is not being detected by a sheet switch 311. Temperature data of the process cartridge 5 is used to control a cooling fun (not shown) and the like. A feature of the present embodiment is that common signal lines are used for temperature detection and detection of the remaining amount of toner 28.

Next, a color laser printer included in the present embodiment will be described. It is assumed that the configurations in FIGS. 1 and 2 described in the first embodiment are also applied to the present embodiment. However, the force sensor 301 is replaced by the sheet switch 311, which has the same shape and is placed at the same position as the force sensor 301. The sheet switch 311 according to the present embodiment has two layers of wiring patterns, and a spacer is placed peripherally between the two layers to form a space (gap). The sheet switch 311 is configured such that when top of a sensing surface is pushed, a surface of the upper wiring pattern deforms, coming into contact with the lower wiring pattern. With this configuration, when a pressure equal to or higher than a certain level is applied to the top of the sensing surface, the resistance value becomes almost 0 ohms regardless of the magnitude of pressure. The same components as those in the first embodiment are denoted by the same reference numerals as the corresponding components in the first embodiment, and description thereof will be omitted.

Figure 13B:
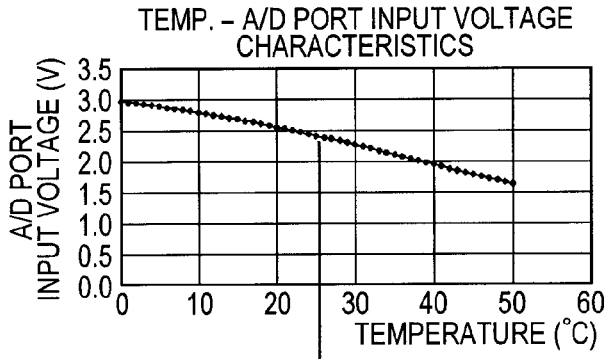
FIG. 13B shows a characteristic graph of a detection result of a remaining toner amount according to the seventh embodiment.
Figure 13D:
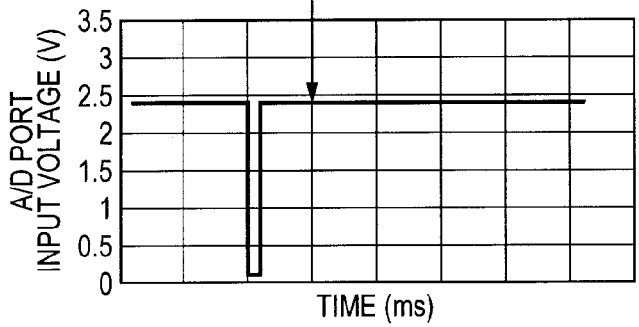

FIG. 13A is a diagram of a circuit adapted to detect variation in resistance value of the sheet switch 311. The sheet switch 311 detects the pressure of toner 28 and thereby detects the remaining amount of toner 28 and a thermistor 41 detects temperature of the process cartridge 5. FIG. 13B is a characteristic graph of A/D input voltage versus temperature, where the A/D input voltage which is input in the A/D port is obtained by voltage division between the thermistor 41 and voltage dividing-resistor 37. FIG. 13C is a table Q which represents the characteristic graph of FIG. 13B in tabular form. FIG. 13D is a waveform of the A/D input voltage (V) input in the A/D port of the CPU 40 when the color laser printer is printing. The graph in FIG. 13B is based on the following conditions: the temperature of the process cartridge 5 is 25° C. and the remaining amount of toner 28 is 100%. For data in the time period when the input is Low, the table T in FIG. 4C is referred to.

Remaining Toner Amount Detection Sequence

Figure 14:
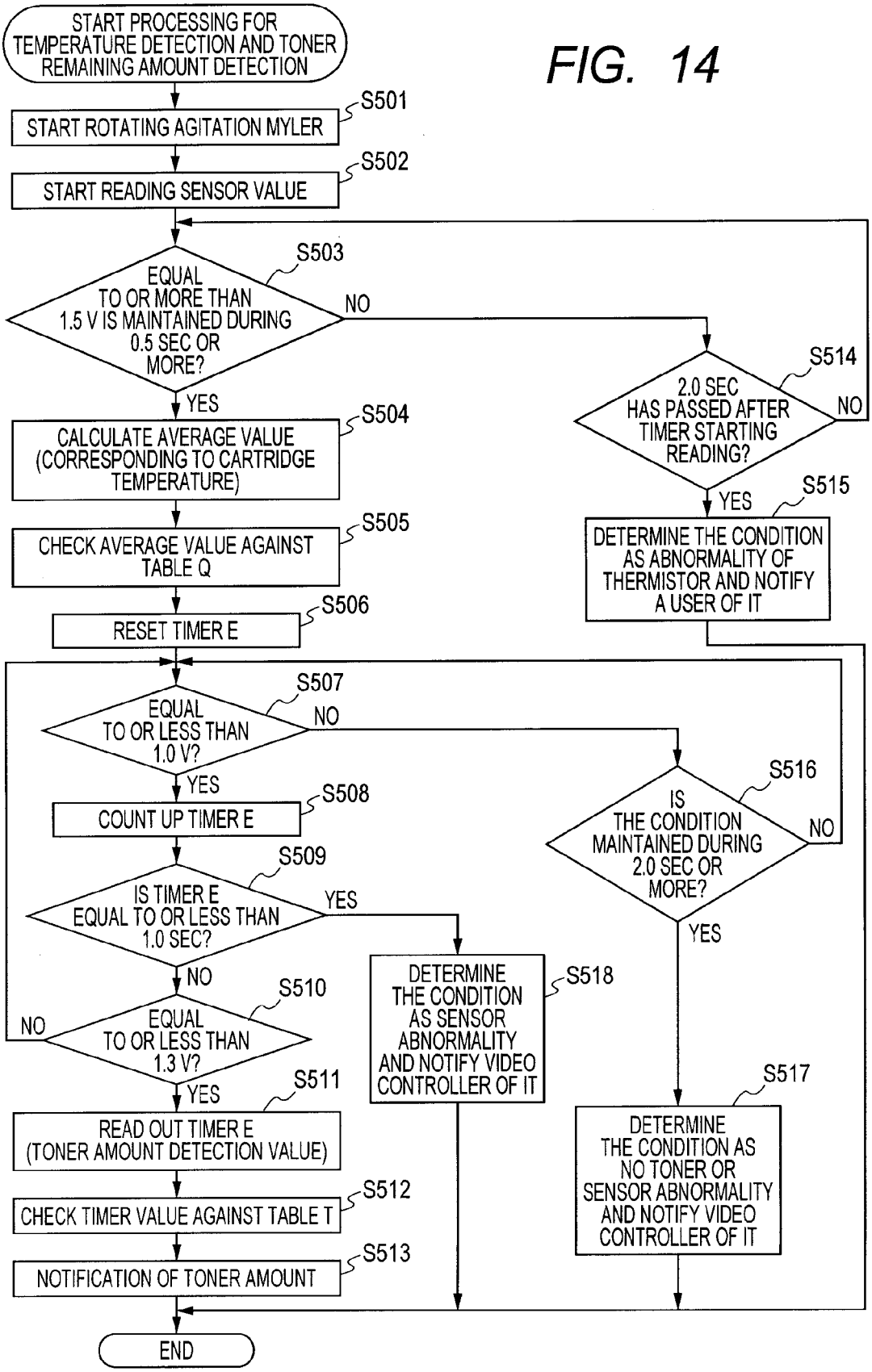
FIG. 14 shows a flowchart of remaining toner amount detection according to the seventh embodiment.

FIG. 14 is a flowchart describing a remaining toner amount detection process which combines a temperature detection process, according to the present embodiment. First, the CPU 40 rotates the agitating member 34 (S501) and reads the A/D port input voltage (S502). To read the initial value of the voltage corresponding to the process cartridge (5) temperature at which no pressure is applied to the sheet switch 311, the CPU 40 determines whether a period in which the voltage is 1.5 V or above has continued for 0.5 second or more (S503). If a period has continued, the CPU 40 calculates an average value of the voltages corresponding to the cartridge temperatures over the 0.5 second (S504). The CPU 40 detects the temperatures of the process cartridge 5 by referring to the table Q (S505). The CPU 40 resets a timer E for detection of the remaining amount of toner 28 (S506). The CPU 40 determines whether the voltage read from the A/D port is 1.0 V or below (S507). If the voltage is 1.0 V or below, the CPU 40 determines that pressure is being applied to the sheet switch 311 and starts the timer E (S508). When the timer E reaches or exceeds 1.0 second, the CPU 40 determines that something is wrong with the sensor and notifies the video controller 42 thereof (S518). If the A/D port reaches or exceeds 1.3 V (Yes in S510) while the timer E indicates 1.0 second or more (No in S509), the CPU 40 reads the value of the timer E as a voltage value corresponding to a detected value of the toner amount (S511), and refers to the table T for a corresponding value (S512). Subsequently, the CPU 40 notifies the video controller 42 of the remaining amount of toner 28 (S513). If a voltage of less than 1.5 V (No in S503) continues for 2.0 seconds of more (Yes in S514) in the process of S503, the CPU 40 determines that something is wrong with the thermistor 41 and notifies the video controller 42 thereof (S515). Also, if the A/D port input voltage of the CPU 40 remains above 1.0 V for 2.0 seconds or more in S507 (Yes in S516), the CPU 40 determines that the toner has run out or that something is wrong with the sensor and notifies the video controller 42 thereof (S517).

The present embodiment provides similar accuracy in detecting the remaining amount of toner to the first embodiment. Furthermore, since common signal lines can be used for the temperature detection of the process cartridge 5 and for the sheet switch 311, the following advantages are available compared to when separate signal lines are used. First, the number of signal lines can be reduced by two, resulting in reduced wires and connecters.

Furthermore, the A/D input ports of the CPU 40 can be reduced as well. This enables cost reductions. In the present embodiment, the thermistor 41 is used for temperature detection. However, a known posistor (registered trademark) may be used as well.

With the configurations described in the first to seventh embodiments, signal lines for reference potentials are provided separately. However, the process cartridges and the main body of the image forming apparatus are connected so as to have the same reference potential, and thus the signal lines used to provide the reference potential can be shared with the force sensors 301 and sheet switches 311. This reduces the number of signal lines by one and thereby reduces wires and connecters, enabling cost reductions accordingly.

In the examples described in the first to seventh embodiments, pressure is converted into voltage. However, other types of pressure sensors including pressure sensors which convert pressure into current, resistance value, or frequency may be used alternatively.

Furthermore, in the first to seventh embodiments, it is assumed, for ease of understanding, that the respective tables are referred to after each detection. However, if the appropriate table is referred to after data of multiple detections is averaged, detection accuracy can be improved further.

Furthermore, in the examples described in the first to seventh embodiments, the developing unit has an integral structure. However, the present invention is also applicable to a replaceable toner container 23 provided separately from the developing roller 3 if a pressure sensor and sensing member are installed in the toner container 23.

As described above, the image forming apparatus according to the present embodiment can detect the remaining amount successively regardless of whether the amount of toner is large or small using a simple configuration and detect the remaining amount of toner with high accuracy even when the agitation member is operating at high speed.

An eighth embodiment will be described below.

It is assumed that the configuration of the color laser beam printer in FIG. 1 described in the first embodiment is also applied to the present embodiment.

Developing Unit

Figure 15A:
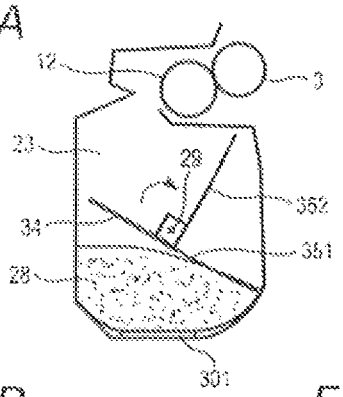
FIGS. 15A, 15B, 15C, 15D and 15E show sectional views of developing units according to eighth, tenth, twelfth and thirteenth embodiments and diagrams showing rotating operation states of sensing members.
Figure 15B:
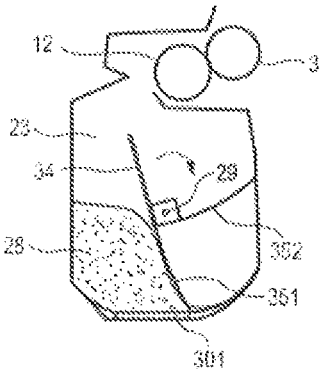

FIG. 15A is a sectional view of the developing unit in the process cartridge 5 according to the present embodiment. The developing unit shown in FIG. 15A includes the toner container 23 containing toner 28 of a given color as well as the agitating member 34 adapted to agitate the toner 28. The agitating member 34 is installed on a rotating shaft 29 so as to be able to turn in a rotational direction indicated by an arrow, within the toner container 23. The rotating shaft 29 is rotatably supported by opposite flanks (not shown) of the developing unit. The rotating shaft 29 has sensing members 351 (first detection member) and 352 (second detection member) mounted thereon and rotates as the agitating member 34 agitates the toner, where the sensing members 351 and 352 are configured to be flexible and used to detect the remaining amount of toner. The sensing member 352 is installed on the rotating shaft 29 of the sensing member 351 at a predetermined angle to the sensing member 351. The predetermined angle may be any angle as long as the sensing member 351 and sensing member 352 are kept from coming into contact with each other and there is a difference between a time difference of the sensing member 352 form the sensing member 351 and a time difference of the sensing member 351 form the sensing member 352 when sensing members 351 and 352 are detected by the force sensor 301. Details will be described with reference to S102 to S105 in FIG. 5. According to the present embodiment, the sensing member 352 is placed 90 degrees behind the sensing member 351 in the rotational direction and is made of a softer material than the sensing member 351. Furthermore, the force sensor 301 adapted to detect the remaining amount of toner in the toner container 23 is installed circumferentially on a wall surface (internal surface, according to the present embodiment) of the developing unit along the rotational direction of the sensing members 351 and 352.

Regarding the radial length from the rotating shaft 29 serving as the center of a circle (hereinafter simply referred to as the radial length), according to the present embodiment, the sensing member 352 is configured to be longer than the sensing member 351. The radial length of the sensing member 351 is set to be about long enough to touch the force sensor 301 while the radial length of the sensing member 352 is set to be long enough to touch a wall surface of the process cartridge 5. However, the sensing member 351 and sensing member 352 are set to such lengths as not to touch each other when agitating the toner. The agitating member 34 is set to be long enough to agitate the toner in the process cartridge 5 sufficiently, but not so long as to affect the force sensor 301 too much. For example, as shown in FIG. 15A, the agitating member 34 is set to such a length as not to touch the wall surface of the process cartridge 5 or the force sensor 301.

The agitating member 34 and sensing member 351 are placed at an angle of approximately 180° to each other in FIG. 15A and configured such that after the toner is agitated by the agitating member 34, the pressure will be detected by the sensing member 351 when condition of the toner is stabilized to some extent. That is, the angle is not limited to 180° as long as the pressure can be detected by the sensing member 351 after the condition of the toner agitated by the agitating member 34 is stabilized to some extent.

Force Sensor

Figure 16A:
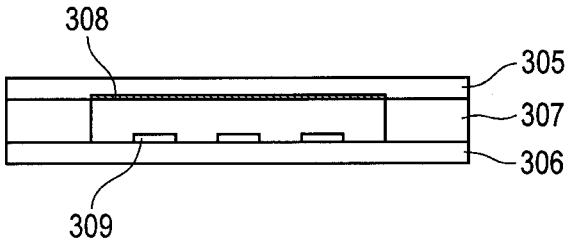
FIGS. 16A, 16B and 16C show sectional views of force sensors according to the eighth to twelfth embodiments.
Figure 16B:
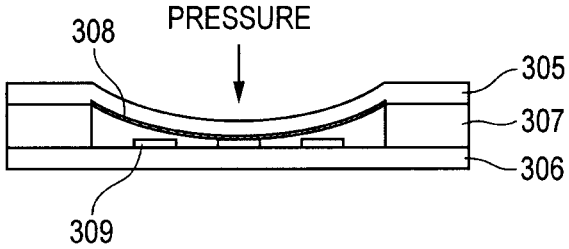
Figure 16C:
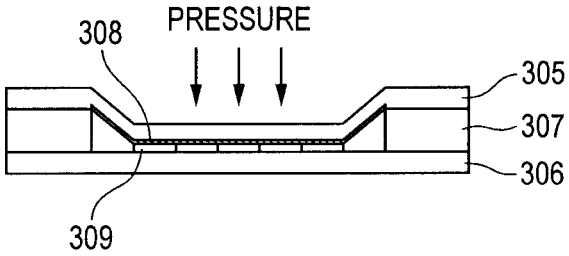

A force sensor (CP1642) (pressure sensitive element) made by IEE is used according to the present embodiment. FIG. 16 are sectional views of the force sensor 301 according to the present embodiment. The sheet 305 and sheet 306 are sheet-like members. The spacer 307 forms a space (gap) between the sheet 305 and sheet 306. The conductive ink 308 is provided on the underside of the sheet 305. The electrode patterns 309 are formed on the sheet 306. A top face of the sheet 305 provides a sensing surface. When the sensing surface is pushed, the top face of the sheet 305 deforms, coming into contact with the electrode patterns 309 located below. FIG. 16A shows a state in which no pressure is applied to the sensing surface of the force sensor 301. No electrode pattern is placed in contact with the conductive ink 308. FIG. 16B shows a state in which a low pressure is applied to the sensing surface of the force sensor 301. One electrode pattern in center is in contact with the conductive ink 308. On the other hand, FIG. 16C shows a state in which a high pressure is applied to the sensing surface of the force sensor 301. Three electrode patterns are in contact with the conductive ink 308. Furthermore, the contact areas of the electrode patterns 309 are increased in the longitudinal direction (in the direction perpendicular to the plane of the paper in FIG. 16C) as well. With this configuration, the force sensor 301 has such a property that the magnitude of pressure is inversely proportional to the resistance value.

Also, the force sensor 301 is configured such that the sensing surface and electric wires (not shown) will be formed integrally. The sensing surface is fixedly bonded to the inner part of the toner container 23 such that the sheet 305 will face toward the inner side of the toner container. Also, the electric wires are led out of the developing unit and a wire exit hole is sealed tightly. The force sensor 301 is connected to the main body 101 via two electrodes (not shown). The electrodes come into contact when the process cartridge 5 is attached to the main body 101.

Rotating Operation of Sensing Member

The sensing members 351 and 352 are made of general-purpose Polyester-film. According to the present embodiment, the sensing members 351 and 352 are, for example, 150 μm thick and 75 μm thick, respectively. The present embodiment creates a difference in the amount of deflection by making the sensing member 351 and sensing member 352 differ in thickness. However, this configuration is not restrictive. For example, a difference in the amount of deflection may be created using different materials of the same thickness. Besides, any other configuration may be used as long as the configuration can produce a difference in the amount of deflection between the sensing member 351 and sensing member 352. In this way, the thicknesses and materials of the sensing members 351 and 352 are parameters used to set the amounts of deflection of the sensing members 351 and 352. Thus, flexibility in setting the amounts of deflection can be increased if both thicknesses and materials are specified appropriately.

Figure 15C:
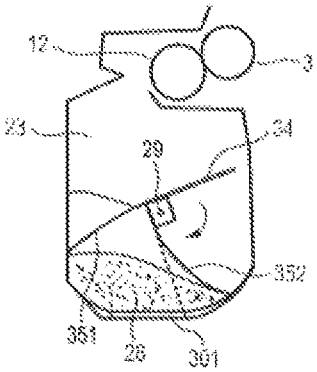
Figure 15D:
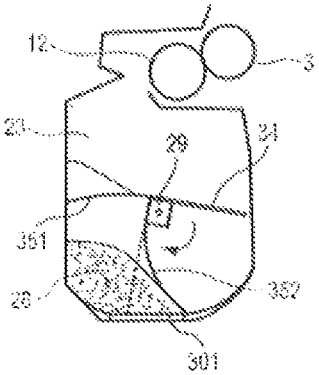
Figure 15E:
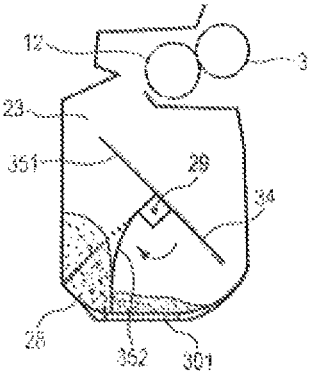

FIGS. 15B to 15E are sectional views of developing units with the sensing members 351 and 352 performing a rotating operation. When performing a rotating operation, the sensing members 351 and 352 deflect as shown in FIGS. 15A to 15E. When there is a large amount of remaining toner, the sensing member 352 is larger in the amount of deflection than the sensing member 351, and consequently deforms greatly backward in the rotational direction. FIGS. 15C to 15E show how the sensing member 352 is deflected greatly backward in the rotational direction, where dotted lines indicate positions of the sensing member 352 when there is no deflection. In this state, there is a long interval between the time when the sensing member 351 passes the sensing surface of the force sensor 301 and the time when the sensing member 352 passes the sensing surface of the force sensor 301. On the other hand, when the amount of remaining toner is decreased, the amount of decrease in the deflection (the amount of decrease from the amount of deflection taking place when there is a large amount of remaining toner) of the sensing member 352 is larger than the amount of decrease in the deflection of the sensing member 351. This results in a reduced interval between the time when the sensing member 351 passes the sensing surface of the force sensor 301 and the time when the sensing member 352 passes the sensing surface of the force sensor 301. The time when the sensing member 351 or 352 passes the sensing surface of the force sensor 301 is the time at which the sensing member 351 or 352 begins to exert a pressure equal to or higher than a certain level to the force sensor 301. According to the present embodiment, the remaining amount of toner is detected based on this principle.

The lengths of the sensing members 351 and 352 in the axial direction (longitudinal direction) are sufficient if they are equal to the longitudinal length of the sensing surface at least on the sensing surface of the force sensor 301, and may be long enough to cover the entire range in the axial direction. Although it has been stated that the sensing member 352 is placed 90 degrees behind the sensing member 351 in the rotational direction and is made of a softer material than the sensing member 351, the present invention is not limited to the arrangement, materials, and thicknesses described above. The sensing members 351 and 352 exert pressure on an inner wall of the developing unit either directly or via toner.

Circuit for Detecting Resistance Value Variation

Figure 17:
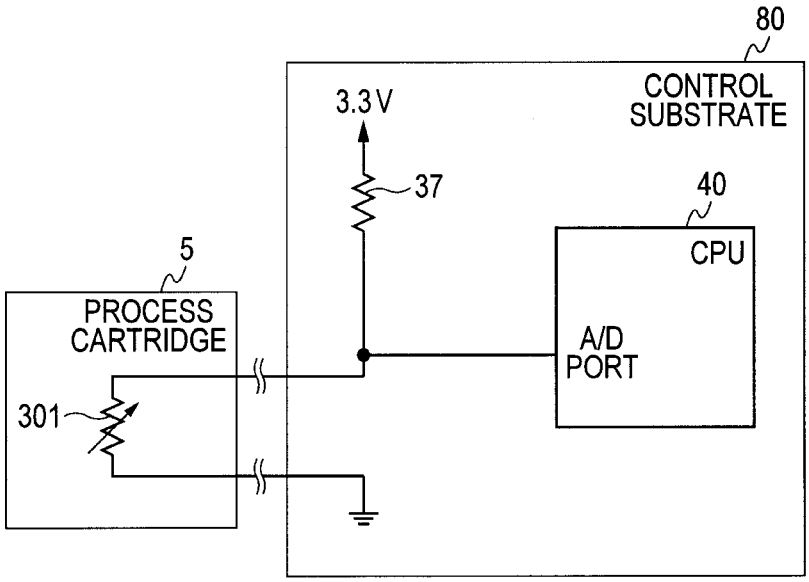
FIG. 17 shows a diagram of a circuit adapted to detect variation in resistance value of the force sensors according to the eighth to eleventh embodiments.

FIG. 17 is a diagram of a circuit adapted to detect variation in resistance value of the force sensor 301. As described in FIGS. 16A to 16C, the resistance value of the force sensor 301 varies with the variation in pressure. The supply voltage of 3.3 VDC is divided between the force sensor 301 and fixed resistor 37, and the resulting voltage is input in the A/D port of the CPU 40 on the control substrate 80.

Remaining Toner Amount Detection Characteristics

Remaining toner amount detection characteristics according to the present embodiment will be described with reference to FIGS. 18A to 18C. FIG. 18A is a characteristic graph of the remaining toner amount (%) versus time difference between the sensing members 351 and 352 as detected by the force sensor 301, showing that the larger the remaining toner amount (%), larger the time difference. FIG. 18B is waveform data of a voltage [V] input in the A/D port of the CPU 40 when the remaining amount of toner is 40%. It can be seen that the time difference between the sensing member 351 (start of detection: 0 msec) and sensing member 352 (start of detection: 320 msec) is 320 msec. FIG. 18C is a table T which associates time differences [msec] with remaining toner amounts (%). Remaining amounts of toner in between numerical values listed in the table T are calculated by known linear interpolation. The values of time calculated here are those according to the present embodiment, and thus calculated values of time will change under different conditions. This is also true of numerical values in the table T used to determine the remaining amount of toner. The table T is prestored, for example, in a ROM (not shown) on the control substrate 80 (this is also true of the subsequent embodiments).

Remaining Toner Amount Detection Process

Figure 19:
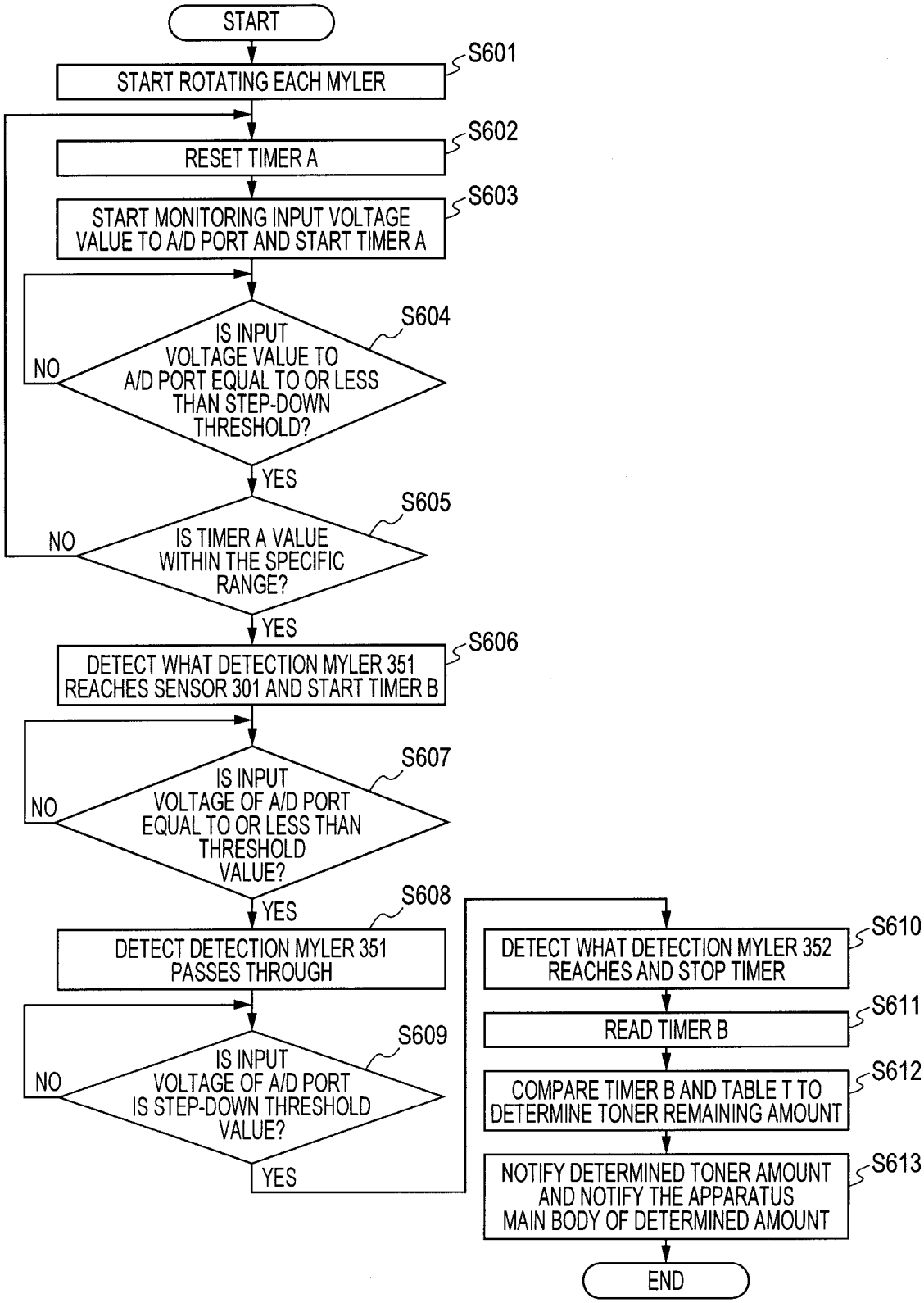
FIG. 19 shows a flowchart describing a remaining toner amount determination process according to the eighth, ninth and thirteenth embodiments.

A remaining toner amount detection sequence according to the present embodiment will be described with reference to a flowchart in FIG. 19. The processes in the flowchart are performed by the CPU 40, and so are the processes in the flowcharts according to the subsequent embodiments. However, the processes are not limited thereto. For example, if an application-specific integrated circuit (ASIC) is mounted in the image forming apparatus, functions of some of the steps may be borne by the ASIC.

In S601, the CPU 40 causes the sensing members 351 and 352 to start rotating. According to the present embodiment, for example, the time for one rotation is set to 1 sec. In S602 to S605, the CPU 40 detects the sensing member 351 out of the two sensing members. This is because the table T used to determine the remaining amount of toner is based on the time difference between the time of detection of the sensing member 351 and time of detection of the sensing member 352. To detect the sensing member 351 without fail, the following detection method is used. In one cycle of the sensing member, the time difference between the time when a fall threshold is detected the first time and the time when the fall threshold is detected the second time is compared with the time difference between the time when the fall threshold is detected the second time and the time when the fall threshold is detected the third time. With the configuration of the present embodiment, the sensing member 352 is placed 90 degrees behind the sensing member 351 in the rotational direction. Therefore, the longer of the two time differences described above corresponds to the time difference between the time of detection of the sensing member 352 and time of detection of the sensing member 351. Thus, the sensing member 351 can be detected by measuring the time differences between detections of the fall threshold using a timer (not shown), comparing the measured time differences with a desired time difference, and detecting the sensing member which has detected the fall threshold the first time in the shorter time difference.

In S602, the CPU 40 resets a timer A. In S603, the CPU 40 starts monitoring the input voltage of the A/D port of the CPU 40 (see FIG. 17). At the same time, the CPU 40 starts the timer A to start counting time. In S604, the CPU 40 determines whether or not the input voltage value of the A/D port is smaller than the fall threshold. That is, the CPU 40 detects the time at which the sensing member 351 starts to exert pressure on the sensing surface of the force sensor 301. According to the present embodiment, the fall threshold of the signal waveform of the monitored voltage is set at 2.0 V. The CPU 40 regards the time when the input voltage value of the A/D port falls below the fall threshold (=2.0 V) as the time when the sensing member 351 has reached the sensing surface of the force sensor 301. Also, if it is determined in S604 that the input voltage value of the A/D port is smaller than the fall threshold, the CPU 40 stops the timer A. If the input voltage value of the A/D port remains above the fall threshold in S604, the CPU 40 continues monitoring the input voltage.

In S605, the CPU 40 determines whether the time detected in S603 indicates the sensing member 351. In so doing, the CPU 40 determines whether the measured value of the timer A falls within a predetermined range (specific range). According to the present embodiment, the predetermined range is between 500 msec and 800 msec (both inclusive). If the value of the timer A is equal to or less than 500 msec, the CPU 40 cannot determine whether the pressure detected by the force sensor 301 is due to the sensing member 351 or sensing member 352. The predetermined range needs to fall between the value obtained by dividing the distance from the sensing member 351 to the sensing member 352 by the rotational speed during one rotation and the value of the time required for the one rotation (both inclusive). If the value of the timer A falls within the predetermined range, the CPU 40 determines that the sensing member 351 has been detected. On the other hand, if the value of the timer A falls outside the predetermined range, the CPU 40 determines that the sensing member 351 has not been detected. Subsequently, the CPU 40 returns to S602 to reset the timer A. Then, the CPU 40 starts monitoring the input voltage of the A/D port again to detect the sensing member 351.

If it is determined in S605 that the value of the timer A falls within the specific range, the CPU 40 detects passage of the sensing member 351 in S606 to S608. In S606, the CPU 40 starts a timer B and thereby starts counting time the moment the sensing member 351 starts exerting pressure on the force sensor 301. In S607, the CPU 40 detects the time when the sensing member 351 finishes exerting pressure on the sensing surface of the force sensor 301. According to the present embodiment, the rise threshold of the signal waveform of the input voltage monitored by the CPU 40 is set at 2.3 V. The time when the rise threshold (=2.3 V) is reached or exceeded is regarded as the time when the sensing member 351 has passed over the sensing surface of the force sensor 301. If the rise threshold is not reached, the CPU 40 continues monitoring the input voltage. The reason why the fall threshold is set to 2.0 V and the rise threshold is set to 2.3 V is to provide hysteresis and thereby prevent noise-induced malfunctions.

If it is determined in S607 that the input voltage value of the A/D port is equal to or larger than the rise threshold, the CPU 40 detects in S608 that the sensing member 351 has passed over the sensing surface of the force sensor 301. Subsequently, the CPU 40 starts to detect the sensing member 352 in S609 to S610. In S609, the CPU 40 detects the time at which the sensing member 352 starts to exert pressure on the sensing surface of the force sensor 301. According to the present embodiment, the fall threshold of the signal waveform of the input voltage monitored by the CPU 40 is set at 2.0 V. The CPU 40 regards the time when the input voltage value of the A/D port falls below the fall threshold (=2.0 V) as the time when the sensing member 352 has reached the sensing surface of the force sensor 301. At this point, the CPU 40 stops the timer B. If the input voltage value remains above the fall threshold in S609, the CPU 40 continues monitoring the input voltage. In S610, the CPU 40 stops the timer B at the time when the sensing member 352 starts exerting pressure on the force sensor 301. In S611, the CPU 40 reads the value of the timer B. In S612, the CPU 40 refers to the table T for a value corresponding to the value of the timer B. The table T associates time differences one-to-one with remaining toner amounts as shown, for example, in FIG. 18C. The CPU 40 determines the remaining amount of toner by referring to the table T for a time difference which matches the value of the timer B. If the measured time difference is not listed in the table T, the CPU 40 finds the remaining amount of toner, for example, by linear interpolation based on the values of time difference listed in the table T, as described above. In S613, the CPU 40 informs the video controller 42 in the main body 101 about the remaining amount of toner determined in S612.

According to the present embodiment, the sensing members are rotated in the remaining toner amount detection sequence, but the remaining amount of toner can be detected as long as the sensing members are rotating, for example, during an image forming operation or the like. Also, before detecting the remaining amount of toner, the sensing members may be rotated a few times to stabilize the rotation. Furthermore, although the remaining amount of toner is calculated based on results of a single measurement, the accuracy of detecting the remaining amount of toner can be improved if the remaining amount of toner is determined by averaging multiple measurements. The fall threshold, rise threshold, and value of the timer A defined above are only exemplary. These values are determined by considering the arrangement of the sensing members 351 and 352, the rotational speeds of the sensing members, circuit constants, the output of the force sensor 301, and other factors comprehensively, and the present invention is not limited to these values.

With the sequence described in the present embodiment, the sensing member 351 is detected in S602 to S605 of FIG. 19 and the sensing member 352 is detected subsequently. However, the method described below may be used alternatively. The CPU 40 detects three time points at which pressure starts to be exerted on the force sensor 301. The CPU 40 calculates the time difference between the first time point and second time point as well as the time difference between the second time point and third time point. According to the present embodiment, the smaller of the two time points is determined to be the time difference between the sensing member 351 and sensing member 352. The CPU 40 determines the remaining amount of toner by referring to the table T for a value corresponding to the time difference. This simplifies the sequence.

The input voltage of the A/D port of the CPU 40 is detected according to the present embodiment. However, by digitalizing data using a voltage detection circuit made up of a comparator or the like, the times may be detected at a digital port of the CPU 40. Also, since it is sufficient if the time during which pressure is exerted can be detected, a sheet switch (membrane switch) (described in a thirteenth embodiment) or a general-purpose pressure sensor may be used instead of the force sensor 301. Furthermore, a function to agitate the toner may be borne by the sensing members. This will simplify internal configuration of the developing unit.

In this way, according to the present embodiment, the remaining amount of toner is determined based on the time difference between the time when the sensing member 351 passes the sensing surface of the force sensor 301 and the time when the sensing member 352 passes the sensing surface of the force sensor 301. Consequently, the remaining amount of toner can be detected successively from full (a remaining toner amount of 100%) to empty (a remaining toner amount of 0%). Also, the use of the force sensor 301 can simplify the detection circuit and quick response time of the force sensor 301 can speed up detection time. Furthermore, since deflection of the sensing members is stable depending on the remaining amount of toner even when the sensing members are rotating at high speed, the remaining amount of toner can be detected simultaneously with an image forming operation.

According to the present embodiment, the remaining amount of toner is determined based on the time difference between the time when the sensing member 351 starts exerting pressure on the force sensor 301 and the time when the sensing member 352 starts exerting pressure on the force sensor 301. However, the remaining amount of toner may be determined based on the time difference between the time when the sensing member 351 finishes exerting pressure on the force sensor 301 and the time when the sensing member 352 finishes exerting pressure on the force sensor 301. Alternatively, the remaining amount of toner may be determined based on the time difference between the time when the sensing member 351 starts exerting pressure on the force sensor 301 and the time when the sensing member 352 finishes exerting pressure on the force sensor 301. Consequently, the time period for which the sensing member 352 exerts pressure on the force sensor 301 can be taken into consideration, allowing the remaining amount of toner to be detected with higher accuracy.

Thus, the present embodiment can detect the remaining amount of toner successively from a full state to an empty state and detect the remaining amount of toner with high accuracy even when the agitation member is operating at high speed.

An ninth embodiment will be described below.

According to the eighth embodiment, the sensing member 351 has flexibility and deflects due to the resistance of toner 28, and the CPU 40 detects the time when the sensing member 351 starts exerting pressure on the force sensor 301. According to the present embodiment, the sensing member 351 (agitation member) has high rigidity and a function to agitate the toner 28. A color laser printer according to the present embodiment is the same as that of the eighth embodiment described above except for the configuration shown in FIG. 15 and configuration of the process cartridge 5, and thus redundant description thereof will be omitted.

Configuration of Process Cartridge

Figure 20:
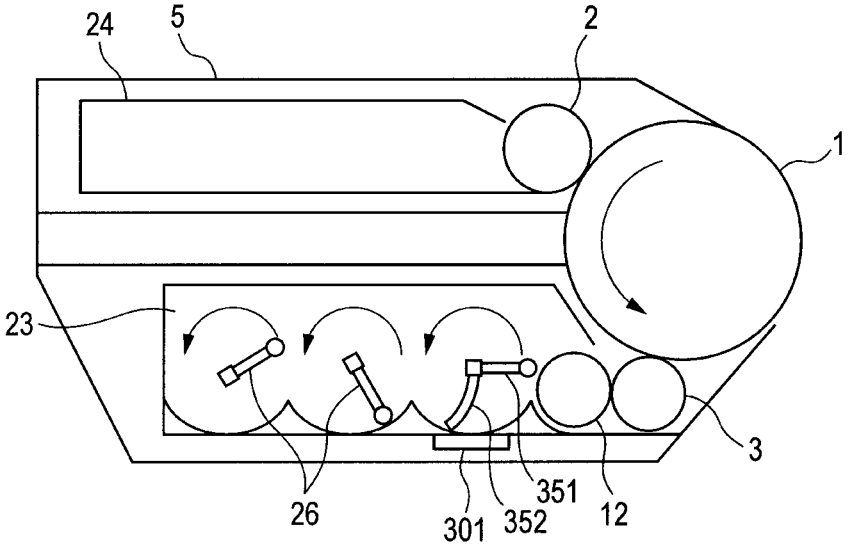
FIG. 20 shows a sectional view of a developing unit according to the ninth and eleventh embodiments.

A process cartridge included in the present embodiment will be described with reference to FIG. 20. FIG. 20 is a sectional view of the process cartridge according to the present embodiment. The same components as those in the first embodiment are denoted by the same reference numerals as the corresponding components in the first embodiment, and detailed description thereof will be omitted. Each toner container 23 contains the toner 28 of a given color. Also, the process cartridge 5 includes the agitation bar 26 adapted to supply toner to the toner replenishing roller 12. The agitation bar 26 agitates the toner 28 by performing a rotary motion around a rotating shaft. The sensing members 351 and 352 used to detect the remaining amount of toner are mounted on another rotating shaft. The sensing member 351 has high rigidity, performs a uniform rotating operation regardless of resistance from the toner 28, and has a soft member attached to its outer tip. The sensing member 352 is a flexible, soft member placed 90 degrees behind the sensing member 351 in the rotational direction. Furthermore, in the process cartridge 5, the force sensor 301 adapted to detect the remaining amount of toner in the toner container 23 is installed circumferentially on the internal surface of the developing unit along the rotational direction of the sensing members 351 and 352.

The flowchart and detection characteristics are similar to those of the eighth embodiment, and thus description thereof will be omitted. The sensing member 351 according to the present embodiment has high rigidity, and thus rotates uniformly regardless of resistance from the toner 28. Consequently, the sensing member 351, which rotates uniformly regardless of the remaining amount of toner, is always detected at regular time intervals by the force sensor 301. Thus, by calculating the difference between the times at which the sensing members 351 and 352 begin to exert a pressure equal to or higher than a certain level to the force sensor 301, the amount of deflection of the sensing member 352 can be detected more accurately, thereby allowing the remaining amount of toner to be detected with higher accuracy.

Thus, the present embodiment can detect the remaining amount of toner successively from a full state to an empty state and detect the remaining amount of toner with high accuracy even when the agitation member is operating at high speed.

A tenth embodiment will be described below.

Whereas in the eighth embodiment, the remaining amount of toner is detected based on a time difference in pressure detection by the force sensor 301, in the present embodiment, the remaining amount of toner is detected based on resistance value variation corresponding to pressure, where the resistance value variation is detected by the force sensor 301. It is assumed that the configurations in FIGS. 1, 15 and 17 described in the above embodiments are also applied to the present embodiment. The same components as those in the first embodiment are denoted by the same reference numerals as the corresponding components in the first embodiment, and detailed description thereof will be omitted.

Remaining Toner Amount Detection Characteristics

Remaining toner amount detection characteristics according to the present embodiment will be described with reference to FIGS. 21A to 21C. FIG. 21A is a characteristic graph of the remaining toner amount (%) versus voltage difference between the sensing members 351 and 352 whose voltages are produced by voltage division between the force sensor 301 and fixed resistor 37, showing that the larger the remaining toner amount (%), smaller the voltage difference [V]. FIG. 21B is waveform data obtained when the remaining amount of toner is 40%. The input voltage of the A/D port of the CPU 40 after the start of detection of the sensing member 351 is 0.4 V and the input voltage after the start of detection of the sensing member 352 is 1.2 V, meaning that the voltage difference is 0.8 V. FIG. 21C is a table N which associates voltage differences [V] with remaining toner amounts (%), where the table N is stored in a ROM of the CPU 40 or the like (not shown). Remaining amounts of toner in between numerical values listed in the table N are calculated by known linear interpolation. The voltage values calculated here are those according to the present embodiment, and thus calculated voltage values will change under different conditions. This is also true of numerical values in the table N used to determine the remaining amount of toner.

Remaining Toner Amount Detection Process

Figure 22:
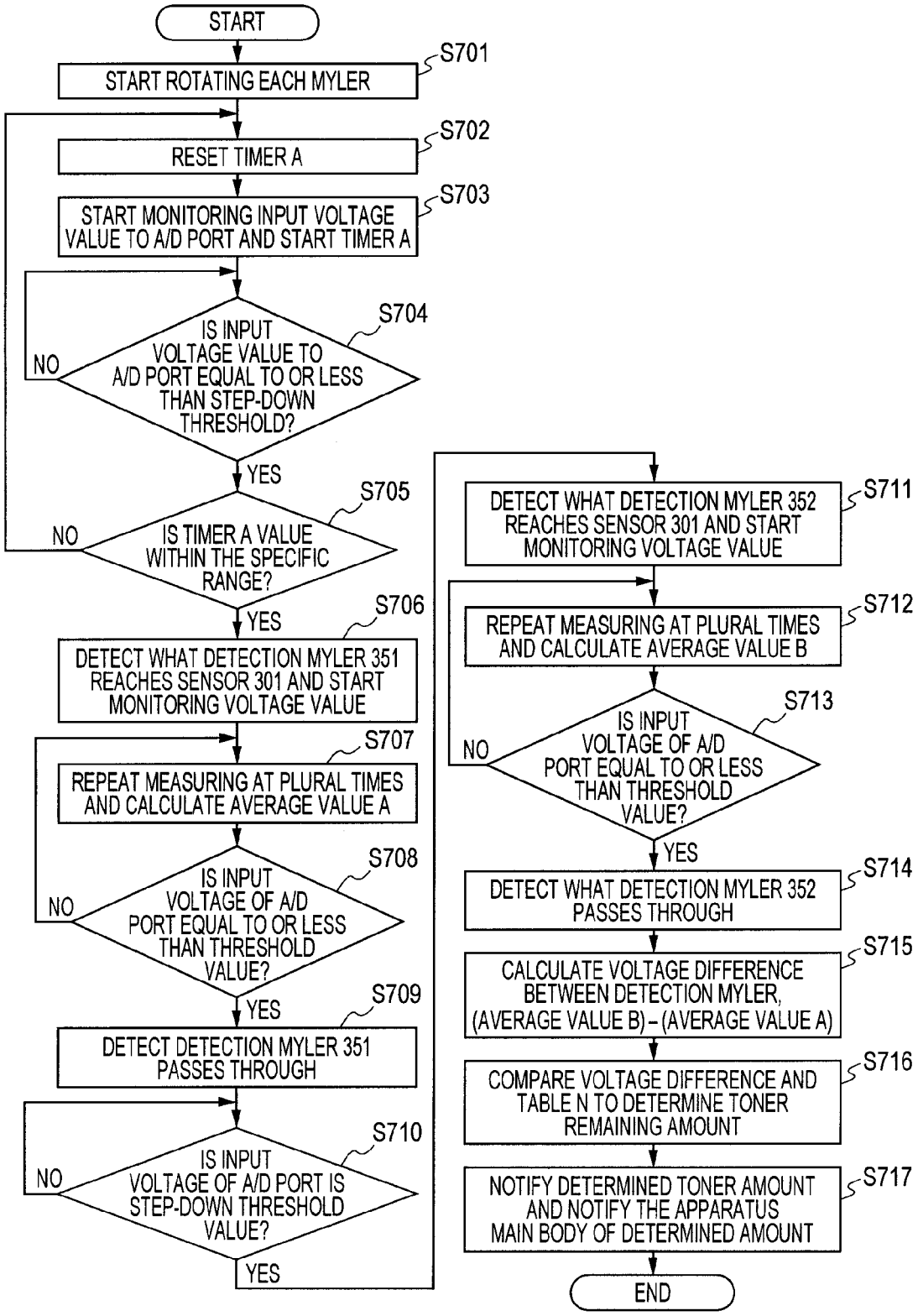
FIG. 22 shows a flowchart describing a remaining toner amount determination process according to the tenth to twelfth embodiments.

A remaining toner amount detection sequence according to the present embodiment will be described with reference to a flowchart in FIG. 22. The processes of S701 to S705 are the same as the processes of S601 to S605 in FIG. 19, and thus description thereof will be omitted. Also, the method for detecting the sensing member 351 without fail is the same as the one described with reference to FIG. 19, and thus description thereof will be omitted. In S706 to S709, the CPU 40 detects passage of the sensing member 351. In S706, the CPU 40 starts monitoring the voltage value the moment the sensing member 351 starts exerting pressure on the force sensor 301. In S707, the CPU 40 takes multiple measurements of the voltage value corresponding to the pressure exerted on the sensing surface of the force sensor 301 by the sensing member 351. Of the voltage values monitored at the A/D port of the CPU 40, the CPU 40 calculates an average A of voltage values regarded as valid, where the voltage values regarded as valid are those which give a rate of change of 0.1 V or less at the measurement intervals used at the A/D port.

In S708, the CPU 40 determines whether or not the input voltage value of the A/D port is equal to or larger than the rise threshold and thereby detects the time when the sensing member 351 finishes exerting pressure on the sensing surface of the force sensor 301. According to the present embodiment, the rise threshold of the signal waveform of the monitored input voltage is set at 2.3 V. The time when the voltage value input in the A/D port of the CPU 40 reaches or exceeds the rise threshold is regarded as the time when the sensing member 351 has passed over the sensing surface of the force sensor 301. If it is determined in S708 that the input voltage value of the A/D port is smaller than the rise threshold, the CPU 40 continues monitoring the input voltage and calculates the average A in S707. The threshold is set in a manner similar to the first embodiment. In S709, the CPU 40 detects that the sensing member 351 has passed over the sensing surface of the force sensor 301. Then, the CPU 40 finishes monitoring the voltage value of the sensing member 351.

Subsequently, the CPU 40 starts to detect the voltage value of the sensing member 352. In S710, the CPU 40 determines whether or not the input voltage value of the A/D port is smaller than the fall threshold and thereby detects the time at which the sensing member 352 starts to exert pressure on the sensing surface of the force sensor 301. According to the present embodiment, the fall threshold of the signal waveform of the monitored voltage is set at 2.0 V. The CPU 40 regards the time when the input voltage value of the A/D port falls below the fall threshold as the time when the sensing member 352 has reached the sensing surface of the force sensor 301. If it is determined in S710 that the input voltage value of the A/D port does not fall below the fall threshold, the CPU 40 continues the process of S710. In S711, the CPU 40 starts monitoring the voltage value at the time when the sensing member 352 starts exerting pressure on the force sensor 301.

In S712, the CPU 40 takes multiple measurements of the voltage value corresponding to the pressure exerted on the sensing surface of the force sensor 301 by the sensing member 352. Of the voltage values monitored at the A/D port of the CPU 40, the CPU 40 calculates an average B of voltage values regarded as valid, where the voltage values regarded as valid are those which give a rate of change of 0.1 V or less at the measurement intervals used at the A/D port. In S713, the CPU 40 determines whether or not the input voltage value of the A/D port is equal to or larger than the rise threshold and thereby detects the time when the sensing member 352 finishes exerting pressure on the sensing surface of the force sensor 301. According to the present embodiment, the rise threshold of the signal waveform of the monitored input voltage is set at 2.3 V. The time when the voltage value input in the A/D port of the CPU 40 reaches or exceeds the rise threshold is regarded as the time when the sensing member 352 has passed over the sensing surface of the force sensor 301. If it is determined in S713 that the input voltage value of the A/D port does not reach or exceed the rise threshold, the CPU 40 continues monitoring the voltage and calculates the average B in S712. The threshold is set in a manner similar to the eighth embodiment.

In S714, the CPU 40 detects that the sensing member 352 has passed over the sensing surface of the force sensor 301. Then, the CPU 40 finishes monitoring the voltage value of the sensing member 352. In S715, the CPU 40 calculates a voltage difference (B−A) using the average A of input voltage values calculated in S707 and the average B of input voltage values calculated in S712. For example, in the example of FIG. 21B, A=0.4 V and B=1.2 V, and thus B−A=1.2−0.4=0.8. In S716, the CPU 40 compares the voltage difference calculated in S715 with the table N in FIG. 21C, and thereby determines the remaining amount of toner. For example, in the example of FIG. 22, using the table N, the CPU 40 determines the remaining amount of toner to be 40% which corresponds to 0.8 V. If a value matching the calculated voltage difference [V] is not listed in the table N, the CPU 40 calculates the remaining amount of toner [%] by linear interpolation as described above. In S717, the CPU 40 informs the video controller 42 in the main body 101 about the remaining amount of toner determined (or calculated by linear interpolation) in S716.

With the sequence described in the present embodiment, the sensing member 351 is detected in the processes of S702 to S705 and the sensing member 352 is detected subsequently. However, the method described below may be used alternatively. The CPU 40 detects two time points at which pressure starts to be exerted on the force sensor 301. The CPU 40 calculates the average A of voltage values and average B of voltage values at the first and second time points. Then, the CPU 40 calculates the absolute value of the difference between the average A and average B, and determines the remaining amount of toner by referring to the table N. This simplifies the sequence. Consequently, even if the sensing member 352 is detected first, by calculating the absolute value of the voltage difference between the input voltage values of the two sensing members, the remaining amount of toner can be determined using the table N.

In this way, according to the present embodiment, the remaining amount of toner is determined based on the difference between the value of pressure exerted on the sensing surface of the force sensor 301 by the sensing member 351 and the value of pressure exerted on the sensing surface of the force sensor 301 by the sensing member 352. Consequently, the remaining amount of toner can be detected successively from full (a remaining toner amount of 100%) to empty (a remaining toner amount of 0%). Also, the use of the force sensor 301 can simplify the detection circuit and quick response time of the force sensor 301 can speed up detection time. Furthermore, since deflection of the sensing members is stable depending on the remaining amount of toner even when the sensing members are rotating at high speed, the remaining amount of toner can be detected simultaneously with an image forming operation. Besides, by switching between two modes of detection control, the remaining amount of toner down to approximately 30% may be detected using the detection control according to the first embodiment and the remaining amount of toner smaller than approximately 30% may be detected using the detection control according to the present embodiment. This will allow the remaining amount of toner to be detected with higher accuracy in any amount range from 0% to 100% than when one of the control modes is used alone.

Thus, the present embodiment can detect the remaining amount of toner successively from a full state to an empty state and detect the remaining amount of toner with high accuracy even when the agitation member is operating at high speed.

An eleventh embodiment will be described below.

According to the tenth embodiment, the sensing member 351 has flexibility and deflects due to the resistance of toner 28, and the force sensor 301 detects the time when the sensing member 351 starts exerting pressure. According to the present embodiment, the sensing member 351 has high rigidity and a function to agitate the toner 28. The present embodiment uses the configuration (cartridge) of the ninth embodiment illustrated in FIG. 20 and a remaining toner amount detection sequence similar to the process described in FIG. 22. The flowchart and detection characteristics are similar to those of the tenth embodiment in FIGS. 21A to 22, and thus description thereof will be omitted. The sensing member 351 according to the present embodiment has high rigidity, and thus rotates uniformly regardless of resistance from the toner 28. Consequently, the sensing member 351, which rotates uniformly regardless of the remaining amount of toner, exerts a constant pressure on the sensing surface of the force sensor 301. Thus, by calculating the difference between the values of pressure exerted on the sensing surface of the force sensor 301 by the sensing members 351 and 352, respectively, the pressure variation due to the deflection of the sensing member 352 can be detected more accurately, thereby allowing the remaining amount of toner to be detected with higher accuracy.

Thus, the present embodiment can detect the remaining amount of toner successively from a full state to an empty state and detect the remaining amount of toner with high accuracy even when the agitation member is operating at high speed.

A twelfth embodiment will be described below.

According to the present embodiment, the remaining amount of toner is detected based on resistance value variation corresponding to pressure, where the resistance value variation is detected by the force sensor 301. The present embodiment differs from the tenth embodiment in that control which involves switching between voltage dividing-resistors is added to increase accuracy when the amount of remaining toner is decreased. Regarding the color laser printer, process cartridge 5 and the like according to the present embodiment, it is assumed that the configurations in FIGS. 15 and 16 described in the eighth embodiment are applied to the present embodiment. The same components as those in the eighth embodiment are denoted by the same reference numerals as the corresponding components in the eighth embodiment, and detailed description thereof will be omitted. The present embodiment uses the remaining toner amount detection sequence illustrated in FIG. 22.

Circuit for Detecting Resistance Value Variation

FIG. 23A is a diagram of a circuit adapted to detect variation in resistance value of the force sensor 301. The circuit is configured to output a control signal to turn on and off the analog switch 39 from a DO port, i.e., a digital output port of the CPU 40. When the analog switch 39 is turned on, the fixed resistor 38 is connected in parallel to the fixed resistor 37, changing a voltage divider ratio of the fixed resistor 37 to the force sensor 301.

Remaining Toner Amount Detection Characteristics

Remaining toner amount detection characteristics according to the present embodiment will be described with reference to FIG. 23B. FIG. 23B is a characteristic graph of the remaining toner amount (%) versus voltage differences where a solid line represents a voltage difference G1 between the sensing members 351 and 352 whose voltages are produced by voltage division between the force sensor 301 and fixed resistor 37 while a broken line represents a voltage difference G2 between the sensing members 351 and 352 whose voltages are produced by voltage division between the force sensor 301 and a parallel connection of the fixed resistor 37 and fixed resistor 38. Regarding the voltage difference G2, when the remaining amount of toner is small (e.g., 45% or below), there is almost no variation in the voltage difference as shown in FIG. 23B, resulting in reduced accuracy of remaining toner amount determination in this range. Regarding the voltage difference G1, even when the remaining amount of toner is small, there is variation in the voltage difference, allowing the remaining amount of toner to be determined with high accuracy. In this way, the voltage differences G1 and G2 differ in the amount of change used to determine the remaining amount of toner. That is, the voltage differences G1 and G2 differ in sensitivity. FIG. 23C is a table X. Remaining amounts of toner in between numerical values listed in the table X are calculated by known linear interpolation. The voltage values calculated here are those according to the present embodiment, and thus calculated voltage values will change under different conditions. This is also true for the values of voltage differences in the table X used to determine the remaining amount of toner.

According to the present embodiment, when there is a large amount of remaining toner, the CPU 40 sets a DO port output signal to Low. The analog switch 39 turns on, interconnecting the fixed resistor 38 and A/D port. When a new process cartridge 5 is used beginning with a remaining amount of toner of 100%, the voltage difference obtained from the input voltages of the A/D port changes with use in a direction indicated by arrow A in FIG. 23C. Next, according to the present embodiment, when the remaining amount of toner becomes, for example, 45%, the CPU 40 changes the DO port output signal to High. The analog switch 39 turns off, cutting off the fixed resistor 38 from the A/D port. Consequently, the voltage difference obtained from the input voltages of the A/D port changes in a direction indicated by arrow B in FIG. 23C. In this way, when there is a large amount of remaining toner, the CPU 40 calculates the voltage difference G2 and determines the remaining amount of toner based on the voltage difference G2. The voltage difference G2, which changes greatly when there is a large amount of remaining toner, allows determination with higher accuracy than determination based on the voltage difference G1. When there is a small amount of remaining toner, the CPU 40 calculates the voltage difference G1 by switching the sensitivity and determines the remaining amount of toner based on the voltage difference G1. The voltage difference G1, which changes greatly when there is a small amount of remaining toner, allows the remaining amount of toner to be determined with higher accuracy than determination based on the voltage difference G2.

Remaining Toner Amount Detection Process

Figure 24:
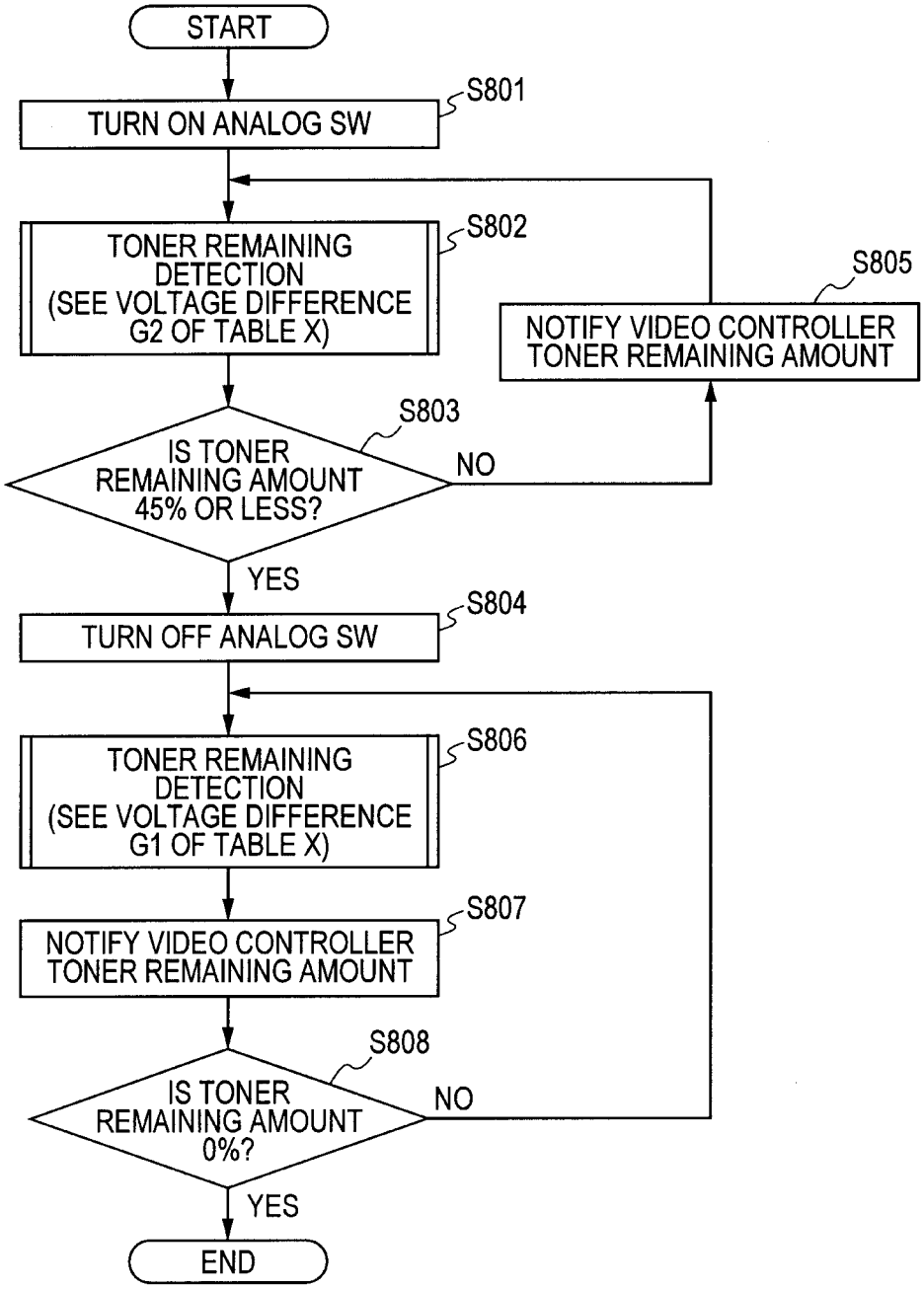
FIG. 24 shows a flowchart describing the process of switching sensitivity according to a remaining amount of toner in the twelfth embodiment.

FIG. 24 is a flowchart according to the present embodiment, illustrating a sequence which begins when a new process cartridge 5 is inserted in the main body 101, involves detecting the remaining amount of toner, and ends by determining that there is no remaining amount of toner (0 [%]). When a new process cartridge 5 is inserted in the main body 101, since the toner 28 remains at 100%, the CPU 40 turns on the analog switch 39 in S801. In this state, the fixed resistor 37 and fixed resistor 38 are connected in parallel as described above and the CPU 40 determines the remaining amount of toner based on the voltage difference G2. In S802, with the analog switch 39 remaining on, the CPU 40 carries out the remaining toner amount detection sequence according to the flowchart described in FIG. 22. However, in the process of S216 in FIG. 22, the CPU 40 refers to the voltage difference G2 in the table X in FIG. 23C. In S803, the CPU 40 determines whether the remaining amount of toner determined using S216 of FIG. 22 in the remaining toner amount detection sequence of S802 is 45% or below. If it is determined in S803 that the remaining amount of toner is not 45% or below, i.e., the remaining amount of toner is larger than 45%, the CPU 40 notifies the video controller 42 about the determined remaining amount of toner in S805 and then returns to the process of S802.

If it is determined in S803 that the remaining amount of toner is 45% or below, the CPU 40 sets the DO port output signal to High and thereby turns off the analog switch 39 in S804. Subsequent processes are performed with the analog switch 39 kept off. As described above, in this state, the fixed resistor 38 is disconnected and the CPU 40 determines the remaining amount of toner based on the voltage difference G1. In S806, the CPU 40 carries out the remaining toner amount detection sequence according to the flowchart described in FIG. 22. However, in the process corresponding to the process of S716 in FIG. 22, the CPU 40 refers to the voltage difference G1 in the table X in FIG. 23C. In S807, the CPU 40 notifies the video controller 42 about the remaining amount of toner determined using S716 of FIG. 22 in the remaining toner amount detection sequence of S806. In S808, the CPU 40 determines whether the remaining amount of toner determined in S806 is 0%. If it is determined in S808 that the remaining amount of toner is not 0%, the CPU 40 returns to the process of S806. If it is determined in S808 that the remaining amount of toner is 0%, the CPU 40 finishes the process.

In this way, by switching sensitivity according to the remaining amount of toner, variation in the remaining amount of toner can be detected with high accuracy, resulting in improved accuracy. Also, the present embodiment can be combined with detection control according to the third and fourth embodiments. Specifically, since the remaining toner amount detection sequence in S802 and S806 of FIG. 24 can be substituted with the remaining toner amount detection sequence according to the third and fourth embodiments, the remaining amount of toner can be detected with higher accuracy in any amount range from 0% to 100% than when one of the control modes is used alone.

Thus, the present embodiment can detect the remaining amount of toner successively from a full state to an empty state and detect the remaining amount of toner with high accuracy even when the agitation member is operating at high speed.

A thirteenth embodiment will be described below.

The present embodiment differs from the eighth embodiment in that whereas in the eighth embodiment, the remaining amount of toner is detected based on the period of time for which pressure is detected by the force sensor 301, in the present embodiment, the remaining amount of toner is detected through detection of the time difference between the times when pressure is detected by the sheet switches 311 (switching elements). Besides, the temperature of the process cartridge 5 is detected during a period of time when no pressure is detected by the sheet switches 311. Temperature data of the process cartridge 5 is used to control a cooling fan (not shown) and the like. A feature of the present embodiment is that common signal lines are used for detection of the temperature and detection of the remaining toner amount. Description of the color laser printer, process cartridge 5 and the like according to the present embodiment will be omitted, assuming that the configurations in FIGS. 15A to 16C and 19 described in the eighth embodiment are applied to the present embodiment. However, the force sensor 301 is replaced by the sheet switch 311, which has the same shape and is placed at the same position as the force sensor 301.

Configuration of Sheet Switch

The sheet switch 311 according to the present embodiment has two layers of wiring patterns, and a spacer is placed peripherally between the two layers to form a space (gap). When the top face of the sensing surface is pushed, the wiring pattern on the top face deforms, coming into contact with the wiring pattern on the bottom face. With this configuration, when a pressure equal to or higher than a certain level is applied to the top of the sensing surface, the resistance value becomes almost 0 ohms regardless of the magnitude of pressure. In this way, the sheet switch 311 turns on and off according to pressure.

Circuit for Detecting Resistance Value Variation

Figure 25:
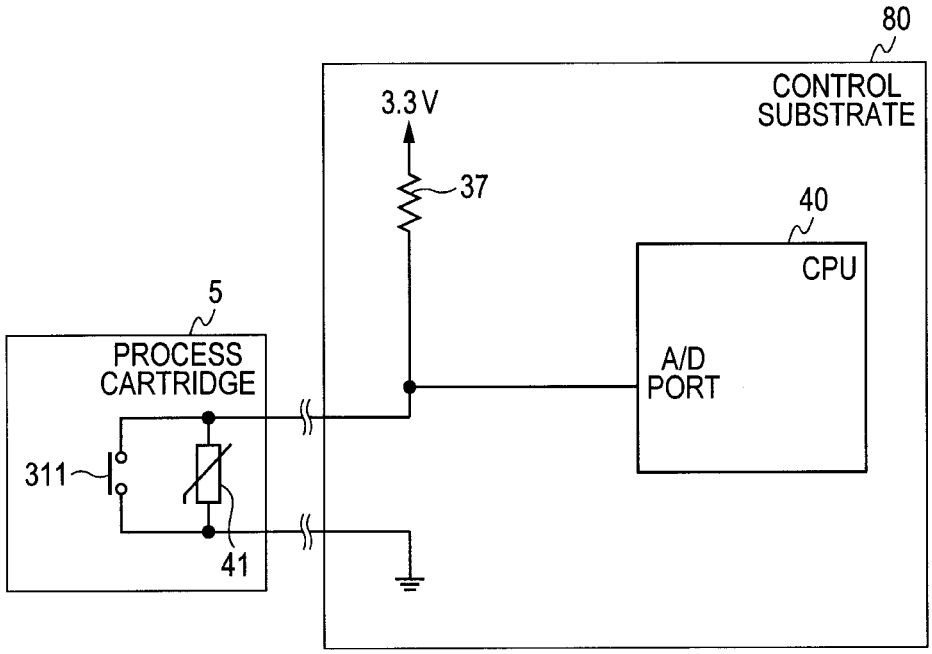
FIG. 25 shows a diagram of a circuit adapted to detect variation in resistance value of a sheet switch according to the thirteenth embodiment.

FIG. 25 is a diagram of a circuit adapted to detect variation in the resistance value of the sheet switch 311. The sheet switch 311 is intended to detect the remaining amount of toner in the toner container 23 and the thermistor 41 is intended to detect the temperature of the process cartridge 5. When the sheet switch 311 is on, a voltage resulting from voltage division between the thermistor 41 and fixed resistor 37 is input in the A/D port of the CPU 40 and the remaining amount of toner is determined based on a time difference as in the case of the first embodiment. Besides, according to the present embodiment, the temperature is detected based on the input voltage of the A/D port of the CPU.

Remaining Toner Amount Detection Characteristics

Figure 26A:
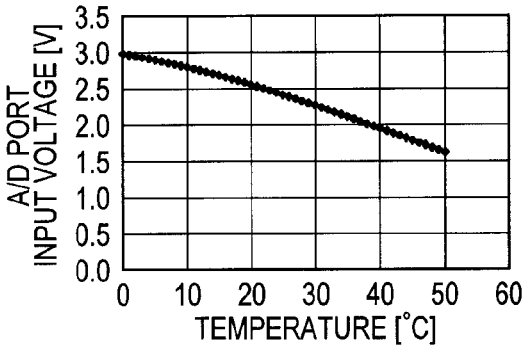
FIG. 26A shows a characteristic graph according to the thirteenth embodiment.
Figure 26B:
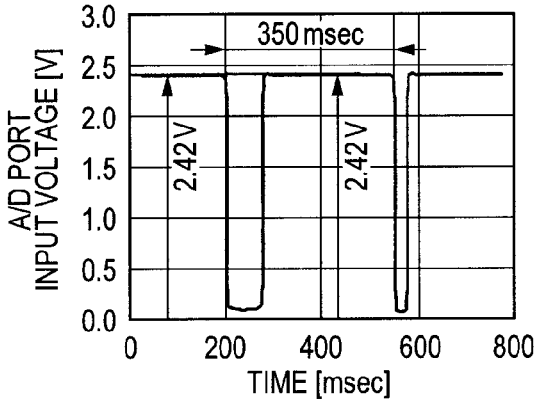
FIG. 26B shows a waveform according to the thirteenth embodiment.

FIG. 26A is a characteristic graph of the input voltage of the A/D port of the CPU 40 versus temperature, showing that the higher the temperature [° C.], the lower the input voltage [V] of the A/D port, where the input voltage is produced by voltage division between the thermistor 41 and fixed resistor 37. FIG. 26B is a waveform of a voltage input in the A/D port of the CPU 40 at a temperature of 25° C. when the color laser printer is printing. FIG. 26C is a table Q which represents the characteristic graph of the A/D port input voltage versus temperature in tabular form, where the A/D port input voltage is produced by voltage division between the thermistor 41 and fixed resistor 37. Remaining amounts of toner in between numerical values listed in the table Q are calculated by known linear interpolation. As shown in FIG. 26B, the time difference between detection start times of the sensing member 351 and sensing member 352 is 350 msec. By referring to the table T in FIG. 18C, the CPU 40 determines that the remaining amount of toner is 100% when the time difference is 350 msec. For a relationship between a detection result of the thermistor 41 and temperature, the table Q in FIG. 26C is referred to. In FIG. 26B, since the sheet switch 311 is off and the A/D port input voltage is 2.42V, the CPU 40 determines that the temperature of the process cartridge 5 is 25° C. by referring to the table Q.

Regarding the detection timing of the thermistor 41, when the sensing members are not rotating, since the detection result of the thermistor 41 corresponds to the input voltage of the A/D port of the CPU 40, the CPU 40 determines the temperature based on the value of the A/D port. On the other hand, when the sensing members are rotating, the voltage value of the thermistor 41 can be detected by monitoring voltage values after detection of the time when the sensing member 351 or sensing member 352 finishes exerting pressure on the sheet switch 311. However, the rise threshold and fall threshold used to detect passage and arrival of the sensing member 351 and sensing member 352, for example, in S104, S109 or S107 of FIG. 19 need to be set at values, such as 1.5 V and 1.8 V, smaller than a voltage output range of the thermistor 41.

The present embodiment provides similar accuracy in detecting the remaining amount of toner to the eighth embodiment. Furthermore, since common signal lines can be used for the temperature detection of the process cartridge 5 and for the sheet switch 311, the following advantages are available compared to when separate signal lines are used. First, the number of signal lines can be reduced by two, resulting in reduced wires and connecters. Also, the A/D ports of the CPU can be reduced as well. This enables cost reductions. In the present embodiment, the thermistor is used as a temperature detecting unit. The thermistor used in the present embodiment is a type whose resistance decreases with increases in temperature, but a type whose resistance increases with increases in temperature may be used alternatively. Also, even when the force sensor 301 is connected in parallel to the thermistor 41 instead of the sheet switch 311, the temperature can be detected when the sensing members are not rotating or when the sensing members are rotating, but not exerting pressure on the force sensor 301.

Thus, the present embodiment can detect the remaining amount of toner successively from a full state to an empty state and detect the remaining amount of toner with high accuracy even when the agitation member is operating at high speed.

Other Embodiments

With the configurations described in the eighth to thirteenth embodiments, signal lines for reference potentials are provided separately. However, the process cartridges 5 and the main body 101 of the image forming apparatus are connected so as to have the same reference potential, and thus the signal lines used to provide the reference potential can be shared with the force sensors 301 and sheet switches 311. This reduces the number of signal lines by one and thereby reduces wires and connecters, enabling cost reductions accordingly.

Also, in the examples described in the eighth to thirteenth embodiments, pressure is converted into voltage. However, other types of pressure sensors including pressure sensors which convert pressure into current, resistance value, or frequency may be used alternatively.

Furthermore, in the examples described in the eighth to thirteenth embodiments, it is assumed, for ease of understanding, that the respective tables are referred to after each detection. However, if the appropriate table is referred to after data of multiple detections is averaged, detection accuracy is expected to be improved further.

Also, with the configurations described in the eighth to thirteenth embodiments, two sensing members are placed in the developing unit. However, if three or more sensing members are installed, the remaining amount of toner can be detected with higher accuracy.

Also, in the examples described in the eighth to thirteenth embodiments, the developing unit has an integral structure. However, the present invention is also applicable to a replaceable toner container provided separately from the developing roller if a pressure sensor and sensing member are installed in the toner container.

Thus, the other embodiments can also detect the remaining amount of toner successively from a full state to an empty state and detect the remaining amount of toner with high accuracy even when the agitation member is operating at high speed.

While the present invention has been described with reference to exemplary embodiments, it is to be understood that the invention is not limited to the disclosed exemplary embodiments.

This application claims the benefit of Japanese Patent Application No. 2010-261210, filed Nov. 24, 2010, and Japanese Patent Application No. 2011-045110, filed Mar. 2, 2011, which are hereby incorporated by reference herein in their entirety.

The invention claimed is:

1. An image forming apparatus for forming an image with a developer, comprising:

a developing unit configured to be detachable from and attachable to an image forming apparatus to contain a developer;

a first rotary member and a second rotary member configured to rotate in the developing unit;

a detecting unit installed on an internal surface of the developing unit and configured to detect a signal corresponding to variation of pressure caused by rotation of the first rotary member or the second rotary member in said developing unit; and a switching unit configured to switch between a first determination mode and a second determination mode, wherein the first determination mode is used to determine an amount of the developer in the developing unit based on a signal corresponding to variation of pressure caused by rotation of the first rotary member, and the second determination mode is used to determine the amount of the developer in the developing unit based on a signal corresponding to variation of pressure caused by rotation of the second rotary member.

2. The image forming apparatus according to claim 1, wherein the signal corresponding to the variation of the pressure is information regarding a time period in which the pressure varies.

3. The image forming apparatus according to claim 2, wherein in a case where the amount of the developer is determined to be equal to or less than a predetermined amount in the first determination mode, the switching unit switches to the second determination mode.

4. The image forming apparatus according to claim 1, wherein in a case where the amount of the developer is determined to be equal to or less than a predetermined amount in the first determination mode, the switching unit switches to the second determination mode.

5. The image forming apparatus according to claim 1, wherein a flexibility of the second rotary member is greater than a flexibility of the first rotary member.

6. The image forming apparatus according to claim 5, wherein the detection unit detects a time period in which a pressure provided to the detection unit by rotation of the first rotary member varies in the first determination mode, and a time period in which a pressure provided to the detection unit by rotation of the second rotary member varies in the second determination mode.

7. The image forming apparatus according to claim 5, wherein the detection unit detects a time period in which a pressure provided to the detection unit by rotation of the first rotary member varies in the first determination mode, and a value of a pressure provided to the detection unit by a rotation of the second rotary member varies in the second determination mode.

8. An image forming apparatus for forming an image with a developer, comprising:

a developing unit containing developer;

a first rotary member configured to rotate along with an operation of agitating the developer in the developing unit;

a second rotary member installed on a rotating shaft of the first rotary member at a predetermined angle to the first rotary member;

a detection unit installed on an internal surface of the developing unit and configured to detect a signal corresponding to variation of pressure caused by rotation of the first rotary member or the second rotary member; and a determination unit configured to determine an amount of the developer based on the pressure detected by the detection unit, wherein the determination unit determines the amount of the developer based on a difference between a value detected by the detection unit using the first rotary member and a value detected by the detection unit using the second rotary member.

9. The image forming apparatus according to claim 8, wherein the value detected by the detection unit using the first rotary member and the value detected by the detection unit using the second rotary member are pressure or time for which the pressure is detected.

10. The image forming apparatus according to claim 9, wherein the determination unit switches sensitivity of the detection unit according to the determined amount of the developer.

11. The image forming apparatus according to claim 8, wherein the detection unit is a pressure sensitive element whose resistance value varies according to pressure or a switching element which turns on and off according to pressure.

12. The image forming apparatus according to claim 8, wherein the first rotary member and the second rotary member have flexibility, and wherein the second rotary member has a larger amount of deflection than the first rotary member or the first rotary member has higher rigidity than the second rotary member.

13. The image forming apparatus according to claim 8, wherein the first rotary member is an agitation member adapted to agitate the developer in the developing unit.

* * * * *